US007659465B1

(12) United States Patent
McEwen

(10) Patent No.: US 7,659,465 B1
(45) Date of Patent: Feb. 9, 2010

(54) METHOD OF ATTACHMENT FOR STRING TENSION ADJUSTMENT DEVICES (TUNERS) FOR STRINGED INSTRUMENTS AND STRING INSTRUMENTS FORMED THEREBY

(76) Inventor: Paul A. McEwen, 67 White Oak Dr., Harwinton, CT (US) 06791

( * ) Notice: Subject to any disclaimer, the term of this patent is extended or adjusted under 35 U.S.C. 154(b) by 0 days.

(21) Appl. No.: 12/124,386

(22) Filed: May 21, 2008

Related U.S. Application Data

(60) Provisional application No. 60/930,953, filed on May 21, 2007.

(51) Int. Cl.
*G10D 3/14* (2006.01)

(52) U.S. Cl. ..... 84/304

(58) Field of Classification Search ..... 84/267, 84/293, 304–306, 297 R, 297 S
See application file for complete search history.

(56) References Cited

U.S. PATENT DOCUMENTS 3,486,408 A 12/1969 Gross
4,408,515 A 10/1983 Sciuto
5,463,924 A * 11/1995 Reuterfors ..... 84/304
5,747,712 A * 5/1998 Goto ..... 84/306
5,753,838 A 5/1998 Vanga, II

* cited by examiner

*Primary Examiner*—Kimberly R Lockett
(74) *Attorney, Agent, or Firm*—Carmody & Torrance LLP

(57) ABSTRACT

A method of adding at least one more string to a stringed instrument having an initial plurality of strings and an initial plurality of tuners equaling the number of initial plurality of strings, wherein the stringed instrument comprises a headstock on which is disposed the initial plurality of tuners, a neck and a body coupled to the neck, wherein among other things, the headstock has a front surface, a rear surface and at least one side planer surface and at least one elongated bore in the side planer surface and wherein the headstock further comprises at least one individual aperture extending from the front surface to the rear surface of the headstock and the elongated bore extends perpendicularly to the aperture, wherein the method comprises the steps of inserting a steel flanged insert into the individual aperture; inserting a shaft, having a first end and a second end, in the elongated bore such that the first end of the shaft extends into the aperture of the headstock; coupling a first end of the at least one more string to the first end of the shaft and coupling a second end of the at least one more string to the termination section; and securing the shaft to the headstock. In a particular feature, the steel flanged insert prevents the at least one more string from direct contact with an edge of the aperture and facilitates an improved tone transfer to the headstock.

18 Claims, 19 Drawing Sheets

METHOD OF ATTACHMENT FOR STRING TENSION ADJUSTMENT DEVICES (TUNERS) FOR STRINGED INSTRUMENTS AND STRING INSTRUMENTS FORMED THEREBY

RELATED APPLICATIONS

This application claims the benefit of U.S. Provisional Application No. 60/930,953, filed May 21, 2007, the subject matter of which is also incorporated by reference as if fully set forth herein.

BACKGROUND OF THE INVENTION

The present invention relates generally, to stringed musical instruments, and more concisely, is directed to the headstock, and string tension adjustment devices (tuners), utilized with stringed musical instruments. More particularly, a means/method of attachment, of string tension adjustment devices (tuners), to an existing stringed instrument headstock, aftermarket, or from the standpoint of primary, newly manufactured stringed instrument headstocks, either as the main means of string tension adjustment, or in conjunction with the more "classic" method of attachment for string tension adjustment devices, to add the desired amount of strings, and to achieve the desired effect. Usually but not limited to changing a single stringed instrument, to a double stringed instrument, and, but not limited to, from 6 to 12 strings, while retaining the character of that stringed instrument headstock and also while not compromising the structural integrity, or original intended design.

It will be appreciated that although the present invention can be used on any style stringed instrument headstock, from a conversion of an existing stringed instrument headstock aftermarket, to a newly manufactured stringed instrument headstock, this means/method of attachment is particularly useful when converting particular style headstocks, well known to those skilled in the art, from a set number of string tension adjustment devices (tuners), to a greater number of said devices, which heretofore has not been possible due to limitations in the surface area needed for the attachment of said devices.

To the applicant's knowledge there have been 3 patented inventions addressing the adding, or subtracting, the useable number of strings to a stringed instrument, and a variety of means to achieve this result. The first such device was invented by J. E. Gross, and was patented in U.S. Pat. No. 3,486,408, The next invention was invented by Michael N. Scuito, and patented in U.S. Pat. No. 4,408,515, and it adds strings via a completely different method. The next invention was invented by Val George Vanga, and patented in U.S. Pat. No. 5,753,838. This device was a variation of the Gross patent, and worked in relatively the same way, except that the device was affixed permanently on the body, so as to have the operator put each string in it's holder individually.

Two of these 3 aforementioned U.S. Pat. Nos. 3,406,408, and 5,753,838, address the subtracting of useable strings via hooks that remove one half of them from the plurality of strings changing from a 12 string to a 6 string. The remaining U.S. Pat. No. 4,408,515, addresses the addition of strings to a stringed instrument, via added string tension adjustment devices (tuners) on the bridge end, and a plurality of "posts" on the headstock to attach them to. There have also been, in the prior art, headstock designs by manufacturers that allow a plurality of string tension adjustment devices, well known to those skilled in the art, as exemplified by the Fender Telecaster 12, and Stratocaster X11, Gibson's 12 string headstock, the Rickenbacker 360/12, Duesenberg Double Cat-12, Martin D 12-35, and Burrell 12 string headstock, will be addressed.

By way of background, and to describe the type of means/methods, of installing string tension adjustment devices, that have been improved by applicant's invention, the disclosures of the above referenced patents, and prior art have been incorporated herein by reference.

For purposes of convenience in this description of applicant's invention, the attachment of "string tension adjustment devices", will be referred to as "tuners", "stringed instrument headstock" will be referred to as a "headstock", and "stringed musical instrument" will be referred to as a "guitar". Additionally this invention, as addressed herein, will be described as applied to a guitar. Those skilled in the art will recognize that this method/means of attachment for "tuners" can be utilized on any "headstock", on any stringed musical instrument, thus converting, single stringed instruments, to double stringed instruments, or using, for single, stringed instruments, this method of tuner attachment, as a stand alone, primary means of tuner attachment, not only as a conversion, but as used on a newly manufactured instrument, or on a interchangeable, aftermarket neck.

A primary flaw with most of the prior art is that they either: subtract strings from a plurality of strings, double the size of the headstock to accept the added tuners, thus destroying the iconic character and desirable shape of the headstock, add tuners to the bridge that would render the instrument unplayable as a guitar, and couldn't possibly fit, employ large slots for string access, thus compromising string/headstock direct contact, and direct tone transfer, and not possible to do aftermarket, or double the thickness of the headstock to mount, conventionally, tuners underneath. All the aforementioned methods would render a conversion, on a guitar, aftermarket, impossible, and on some styles such as a slanted style, 6 tuners on one side headstock, well known to those skilled in the art, impossible aftermarket, or before market (new manufacture).

In addressing these aforementioned inventions, and prior art, we will first touch on a device invented by J. E. Gross, and patented in U.S. Pat. No. 3,486,408. The J. E. Gross guitar converter, was only available on one manufacturer's instrument, and had to be factory installed. This device pulls 6 strings away from the 12 strings supplied, so the fingering/fretboard hand still fingers 12 strings while the strumming hand strums 6 strings. This device was nearly impossible to deploy, and even more difficult to release. This device pulled the remaining 6 strings and the 6 subtracted strings when returned, horribly out of tune. This device additionally was not a method to add any amount of strings to a stringed instrument, was body mounted, and did not address the headstock, or tuners, at all.

The Sciuto U.S. Pat. No. 4,408,515, unlike '408, adds strings, and discloses the addition of brackets screwed into the headstock, and additional tuners affixed to the bridge. As for the tuners added to the bridge, on a guitar, and the way a guitar bridge is positioned, in relation to most, or all guitar players right hand playing positions, not only would they impede any players strumming (playing) hand resting on the bridge, or muting from that position, there is no possible way 6 additional tuners can be attached to a guitar bridge, due to space limitations. It is shown on a bass, where the bridge, due to the scale length, the bridge and added tuners are not anywhere near the players strumming (playing) hand, they are at the end of the guitar body, this wouldn't be the case with a guitar, and that's why the tuners fit, they wouldn't on a 6 string guitar spaced the way they're shown they would measure 6¾" wide and approximately 2" tall. Not only would this "obstruction" on the bridge make the instrument "unplayable", the players strumming (playing) hand would constantly be in contact with the adjustment buttons of the tuners, this couldn't help but de-tune the instrument.

The Val George Vanga device, U.S. Pat. No. 5,753,838, unlike the Sciuto invention and like the Gross invention, subtracts strings from a plurality (12 shown), to achieve the desired effect. This invention is a bracket, screwed to the body of the instrument, with a series of "hooks" that the desired number of strings, the operator wishes to remove (6 shown), are manually pushed into, to achieve the desired effect. Like the Gross device, this device removes ½ of the desired strings from the plurality (usually 6 from 12), while the fingering/fretboard hand, still had the plurality (12 shown) of strings to finger. To operate this device, the strings would have to be put into their respective hooks one by one unlike the Gross invention. This device would, just as the Sciuto, or Gross devices, deface the instrument in one way or another. This invention would share the same drawbacks with the Gross invention, ie, the finicky properties of the 12 string tuning-wise, is such that pulling 6 of the needed strings, usually in excess of ½ inch plus, downward, and usually, and most probably the octaves, from the remaining plurality, they too would be pulled terribly out of tune. This device would be even harder to employ than the Gross device, shares most of the drawbacks and adds it's own drawbacks.

We now come to the aforementioned prior art referenced herein: The "Fender" Telecaster, as a 12 string, is called the "Telecaster 12", and unlike it's 6 string counterpart, employs a massive, cumbersome, all too long, bilaterally symmetrical, and characteristically nondescript headstock as related to the "slanted" 6 tuners on one side, headstock. The length of this headstock, and the method used to attach the tuners, requires a long bar as a string tensioning device, so as to retain said tension over the nut. They are, due to the oppositional positioning of the tuners, awkward to tune, having to reach down, under, and around, to reach the opposite side of the headstock, and the tuners residing there. These 12 string guitars are only available as a custom shop option, and are most cost prohibitive. Additionally, virtually every manufacturer has a version of this bilaterally symmetrical, large cumbersome headstock.

The next headstock design in the prior art touched upon, will be the Fender Stratocaster X11, offered only on a limited basis, and once again large, cumbersome, purpose driven to accept the added tuners, and virtually identical to the previously mentioned Telecaster 12.

Also illustrated is Fenders "hockey stick" headstock, as a 12 string, and once again the massive size it had to be, to accept 12 tuners, even larger than the two aforementioned Fender style 12 string headstocks.

The next prior art we will visit is the Gibson 12 string headstock, and their method of tuner attachment, doubling the size of their standard headstock, and purpose driven to accept the added tuners. Also, virtually identical, architecturally as the aforementioned Fender 12's and most any other manufacturers offerings as a 12 string, also shown full size, to get a handle on the size they have to be, with their methods of attachment, for tuners. Shown is their 12 string headstock, and also their 6 string version, using the tuner attachment means of the present invention, to convert it to a 12 string. As mentioned, this headstock design, aside from the Fender style, is probably the most prevalent headstock shape on the market, with slight variations making it proprietary to any single manufacturer, and these two illustrations help show how, virtually all makers double the headstock size, as to accept the extra tuners.

The next models in the prior art we come to, will be discussed together, as they share the same headstock architecture. The "Rickenbacker" 360/12, and the "Duesenberg" Double Cat 12. These models, do use their company's, standard size headstock, and attach additional tuners to this headstock design. To do this, they route 2 long slots in the headstock for access to the tuner shafts. This could never be done aftermarket, after the instrument has been finished, and could never be performed on a slanted, 6 tuner/side "Fender" style headstock, due to space limitations, and the slot could never be done in a straight line on this "Fender" style headstock, so as to access the tuner shafts correctly, due to those same space limitations. The secondary set of strings on this style installation, contact the tuner shafts directly, which are mounted, loosely in a wood shaft thus removing any direct, positive, contact to the headstock, by the string, for a negative effect on tone transfer. These type headstocks were also awkward to tune, as you had to reach under and around the headstock to tune.

The next headstock design, is the open, slotted architecture of many of the classical designs, and for purposes of illustration, we will refer to the Martin D 12-35, which is virtually identical to these designs, and Martin has adapted this design to a 12 string instrument. This headstock design is purpose driven to accept 6 additional tuners, as was Fender, and Gibson's designs, but using Martin's method of attaching tuners, the headstock still had to be doubled in length to accept 12 tuners, and reveals two massive slots to provide the string with access to the tuner shaft. This design couldn't be performed aftermarket on a previously finished headstock, and couldn't be performed on a Fender style, 6 tuners on a side headstock, period, due to space limitations.

And lastly we touch upon the Burrell tuner arrangement, from Burrell guitars. They do have a slanted, 6 tuner per side headstock. This headstock, as a 6 string, has all 6 tuners conventionally mounted, 3 conventionally, and 3 tuners mounted in the center of the headstock underneath those, as the headstock is "stepped" lower on one side to accept the additional tuners. As a 12 string, the additional tuners are also attached, conventionally, underneath, and in the middle of the headstock. As stated this is achieved by "stepping" the headstock, to accept these added tuners, and to give distance between the tuner adjustment buttons. The tuners point in the same direction, but are not on the same side, as in the present invention. This headstock is proprietary to Burrell, and this method of attachment for their tuners, will not work on any other stringed instrument headstock, that has seen production, for aftermarket conversion, or before market utilization, as in new manufacture. Shown as a 6 string headstock, to better illustrate their method of tuner attachment.

What is missing in the prior art, and what my invention addresses, is a tuner attachment means for a stringed instrument headstock, that can convert, aftermarket, or before market, any stringed instrument headstock, from a set number of strings to a greater number of strings, while in no way changing: the shape, structural integrity, character or size, and all while being minimally invasive. This attachment method is most useful on any headstock design, including but not limited to headstocks having 6 tuners on one side design, which heretofore hasn't been achieved. This can also be offered as a retrofit 12 string neck with this attachment method, on slanted headstock, 6 tuners on a side, bolt on neck, as not to impair the integrity of a vintage instrument, and it's original parts, so as to switch back to original neck at will, and retain any would be value. As this method of attachment is sonically superior to the conventional tuner attachment methods, this method can also be most desirable as the primary means of attachment for tuners, on a stand alone 6 string installation, on any headstock design. This invention paves the way for virtually any guitar model made, now, at low cost, can be produced as a 12 string, or converted to a 12 string.

SUMMARY AND OBJECTIVES OF THE INVENTION

It is thus an objective of the present invention to provide a tuner attachment means for a stringed musical instrument, that can convert virtually any stringed musical instrument headstock design from, but not limited to, 6 to 12 strings.

It is a further objective of the present invention to make possible, for a variety of guitar makers, and their slanted style, 6 tuners on one side headstock, the addition of tuners for additional paired strings, and has heretofore, not been possible.

Still further, an objective of the present invention is to provide that this means for tuner attachment to a stringed musical headstock, can stand alone as the primary means of string adjustment with a desirable outcome.

Yet further an objective of the present invention is that this means of tuner attachment allows the musical instrument string, to make direct contact with the headstock, for desirable tone transfer, not possible with conventional string/tuner attachment.

Another objective of the present invention is that this means of attachment exerts a much more positive down tension on the string as it travels over the string guide (nut) and on to the shaft of the tuner, due to the inset position of said shaft in the headstock, and all but does away with the need for any ancillary string tensioning devices common on all slanted style, 6 tuners on one side headstocks.

Still further, an objective of the present invention is that this method of attachment for tuners, allows the tuners attached in this method to point up, over the headstock, or down, under the headstock, as both methods are known, and desirable to those skilled in the art.

Yet another objective of the present invention with this method of attachment, and for converting a 6 string musical instrument headstock to accept 12 strings is that the conventionally attached, stock tuners, are free to be used, or replaced with a variety of lateral, or vertical style, tuners available on the market, including, but not limited to, the Steinberger gearless tuners, geared banjo-style tuners, and the lateral-style LSR tuners, all well known, and desirable, to those skilled in the art.

And further, an objective of the present invention is that this method of attachment for tuners, opens up the possibility of using geared, $5^{th}$ string banjo tuners, in the lateral drillings supplied for the present invention on the headstock, allowing the union of this style tuner, and any conventionally mounted, stock tuner, supplied with the instrument. Heretofore, these 5th string, geared, banjo tuners, as used in the industry, were attached laterally, only to the side of a stringed musical instrument neck, and never a side planer surface, of a headstock, as used in the present invention.

Further, an objective of the present invention is that this method for attaching tuners to any phase of production is most useful, this method is particularly useful in adding tuners to a musical instrument headstock that has already been finished, being minimally invasive, and with absolutely no adverse affects on the finish, or structural integrity.

Still further, an objective of the present invention is that this method of attachment can easily be sold as a kit, so as to enable the end user to do the installation Him, or Herself, and thereby saving any labor costs.

Moreover, an objective of the present invention is that with a particular style, 6 tuners on one side, slanted headstocks, well known to those skilled in the art, this method of attachment, when 6 tuners are added, makes it possible to have all 12 tuners on one side of said headstock, easing, and, hastening the tuning process, and superior to any other 12 string design.

Additionally, an objective of the present invention is that this method is used to attach tuners to a stringed musical instrument headstock, presents the possibilities for virtually any stringed musical instrument produced, to now be converted from a set number of strings, to a greater number of strings, usually but not limited to, 6 to 12, or produced brand new, at the factory as a, usually, but not limited to a 12 string instrument. Any model produced, can now be converted aftermarket, or ordered new as a 12 string, without changing headstock design.

Yet further, an objective of the present invention is to all but eliminate the need for the large, cumbersome, top-heavy, fashionably vacant headstocks (see prior art), well known to those skilled in the art, as heretofore the only option offered by most manufacturers, as the only way to procure a 12 string musical instrument headstock.

Another objective of the present invention is also that there are several methods possible to actually fasten the tuners, to the headstock, with this means of tuner attachment, including but not limited to, screws through the tuner body, in registry with holes in the headstock, threading the barrel of the tuner body, to press fit into, screw into, or bond with various adhesives, into the provided lateral drillings, thus eliminating the need for auxiliary fastening screws, useful when space is a consideration. Also, as in the banjo-style $5^{th}$ string geared tuner, having a fluted insert, is press fitted into said lateral provided, headstock drillings. As stated, the latter two, aforementioned fastening methods, can be augmented with various adhesives applied to the inner surface of the predrilled shafts, or the threaded/fluted tuner barrels/inserts, in registry with these predrilled shafts with desirable results, for certain installations.

Further, an objective of the present invention is that the provided flanged, tuner shaft, access drillings on the top, planer surface of the headstock, although are shown as blind, non through drillings, can be provided as through shafts, flanged on both sides, for certain installations with desirable results, for example, but not limited to, a way to cut the string to length, after, it has been inserted through the said tuner shafts.

Also, an objective of the present invention is that this method of attachment, can utilize the stock tuner drillings supplied from the factory, steel flanged inserts added, and tuners inserted laterally as in the present invention, for a sonically superior means of tuner attachment due to the string/headstock direct contact through said steel flanged insert, as a stand alone installation.

Yet further, an objective of the present invention is that with the availability of replacement necks on the aftermarket scene, well known to those skilled in the art, this conversion, on any bolt-on, aftermarket, replacement neck, but in particular, any bolt-on a slanted 6 tuners on one side, aftermarket, replacement neck, now can be converted from 6, to 12 string status, and sold to any given buyer, for the conversion of his, or her instrument, easily installed, and thereby conserving the "original" status of a treasured, or vintage instrument's, "original", neck/headstock, and further enabling the easy restoration of that instrument to "original" status, if desired, thereby, providing unparalled flexibility, at minimal cost.

Further objects and advantages of this invention will become more apparent from a consideration of the drawings and ensuing description.

This invention accordingly comprises the features of construction, combination of elements, sequence of steps and arrangement of part that will be exemplified in the disclosure hereinafter set forth, and the scope of the invention will be indicated in the claims.

Therefore and generally speaking, the present invention is directed to, in a first embodiment, a method of adding at least one more string to a stringed instrument having an initial plurality of strings and an initial plurality of tuners equaling the number of initial plurality of strings, wherein the stringed instrument comprises a headstock on which is disposed the initial plurality of tuners, a neck coupled to the headstock and a body coupled to the neck, wherein the body has a termination section mounted thereon, wherein each of the initial plurality of strings is at one end thereof coupled to a respective one of the initial plurality of tuners, extends over and along the neck and at the other end thereof is coupled to a termination section, wherein the headstock has a front surface, a rear surface and at least one side planer surface and at least one elongated bore in the side planer surface and wherein the headstock further comprises at least one individual aperture extending from the front surface to the rear surface of the headstock and the elongated bore extends perpendicularly to the aperture, wherein the method comprises the steps of inserting a steel flanged insert into the individual aperture; inserting a shaft, having a first end and a second end, in the elongated bore such that the first end of the shaft extends into the aperture of the headstock; coupling a first end of the at least one more string to the first end of the shaft and coupling a second end of the at least one more string to the termination section; and securing the shaft to the headstock; whereby the at least one more string extends over the body and along the neck, and the steel flanged insert prevents the at least one more string from direct contact with an edge of the aperture and facilitates an improved tone transfer to the headstock.

In a specific embodiment a preferred embodiment comprises a method of converting an n-stringed instrument into a 2n stringed instrument, where n is an integer greater than 3 and less than 7, wherein the headstock comprises n elongated bores in the side planer surface of the headstock for each of the additional n strings to be added, and wherein the headstock further comprises n individual apertures each extending from the front surface to the rear surface of the headstock for each of the additional n strings to be added, and wherein each of the added elongated bores extend perpendicularly to each respective aperture and each of the additional n strings at one end is coupled to the respective shaft, wherein the method comprises the steps of inserting a steel flanged insert into each individual aperture; inserting a respective shaft in each elongated bore such that each respective first end of the shaft extends into the aperture of the headstock; coupling a first end of each additional string to a respective first end of the shaft and coupling a second end of the at least one more string to the termination section; and securing each shaft to the headstock; whereby each of the n additional strings extend over the body and along the neck, and each of the steel flanged inserts prevent the respective string from direct contact with an edge of the respective aperture and facilitates an improved tone transfer to the headstock.

In yet further specific embodiments, the present invention is directed to a method of adding the additional n strings by the steps of adding all of the respective number of additional shafts on the same side planer surface of the headstock.

Alternatively, the present invention is directed to a method of adding the additional n strings by the steps of adding only half of all the additional number of shafts on the same side planer surface of the headstock.

The present invention may also include the step of adjusting the string tension of the at least one more string after the step of attaching the at least one more string between the body and the first end of the shaft; wherein the adjusting of the string tension of the at least one more string comprises the step of turning an adjuster coupled to the second end of the shaft.

The present invention is also directed to an n stringed instrument where n is an integer greater than 3 and less than 7, that has been modified to a 2n stringed instrument by the method of adding strings as set forth above and herein.

In a preferred embodiment, the instrument is a guitar.

The present invention, in an alternative preferred embodiment, is directed to a method of making an n-stringed instrument, where n is an integer greater than 3 and less than 7, comprising n tuners, a headstock on which is disposed the n tuners, a neck coupled to the headstock and a body coupled to the neck, wherein the body has a bridge mounted thereon, wherein each of the n strings is at one end thereof coupled to a respective one of n tuners, extends over and along the neck and at the other end thereof is coupled to a termination section, and wherein the headstock has a front surface, a rear surface and at least one side planer surface, and wherein the headstock has n elongated bores in the side planer surface and wherein the headstock further comprises n individual apertures extending from the front surface to the rear surface of the headstock and each respective elongated bore extends perpendicularly to its associated aperture, wherein the method of connecting each of the n strings to the headstock and the body comprises the steps of inserting a steel flanged insert into each individual aperture; inserting a shaft, having a first end and a second end, in each elongated bore such that the end of each respective shaft extends into its associated aperture of the headstock; coupling a first end of each respective string to the first end of the shaft and coupling a second end of each respective string to the termination section; and securing each of the n shafts to the headstock; whereby each of the n strings extend over the body and along the neck, and each respective steel flanged insert prevents its associated string from direct contact with an edge of the respective aperture and facilitates an improved tone transfer to the headstock.

BRIEF DESCRIPTION OF THE DRAWINGS

The above set for and other features of the invention are made more apparent in the ensuing description of the preferred embodiments when read in conjunction with the attached drawing, wherein:

FIG. 1-A is a top planer view of an alternate method of attachment, using a threaded barrel on a sealed tuner, and a provided threaded shaft in the side planer surface, to receive said tuner, via press fitting, or threadably attaching.

FIG. 4 shows the more desirable angle of strings 8, and their departure over the string guide (nut) 18, to their termination to shaft 11, as compared to the strings 13, and their much less desirable angle over said string guide (nut), with it's conventional attachment to shaft 5, all but negating the need for any auxiliary string tension devices 9, (see FIG. 1). FIG. 4, also illustrates the union of string 8, and flanged steel insert 2, as being 8-B, affording a direct, string/headstock contact, as shown. Also in FIG. 4, the flanged steel insert, shown as 2-B, as an optional installation, inserted in drilling 10-B, as the optional through drilling.

DETAILED DESCRIPTION OF THE PREFERRED EMBODIMENTS

Figure 1:
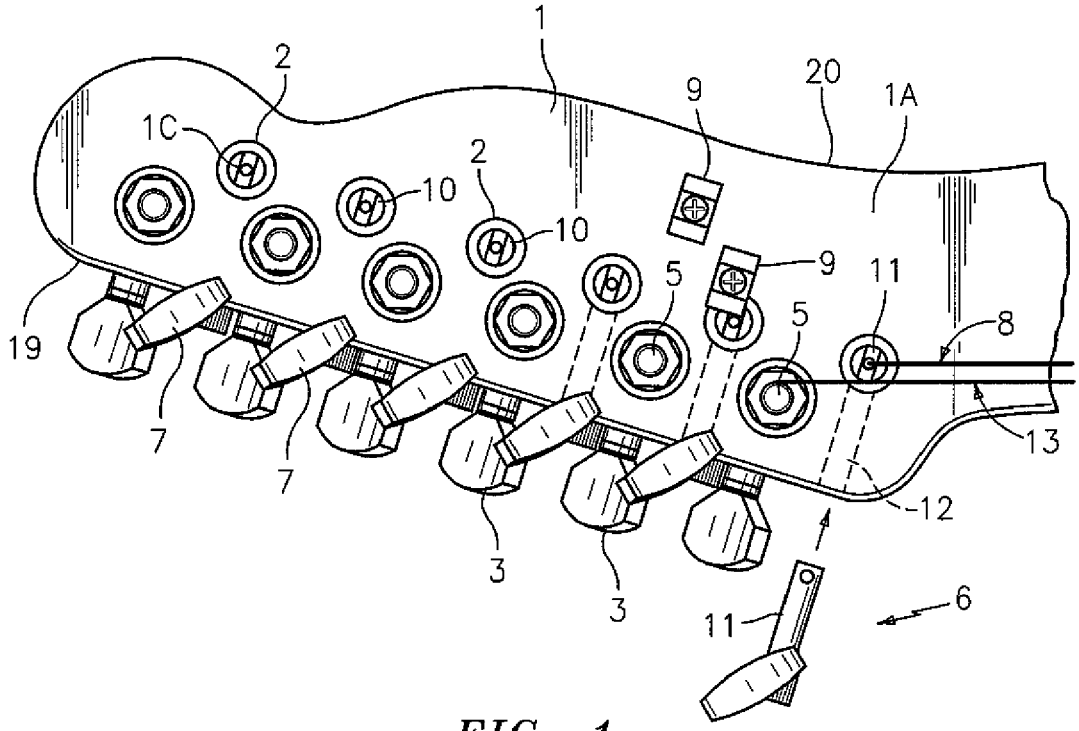
FIG. 1 is a view of the top planer surface of a typical slanted style, 6 tuners on one side, headstock, showing the factory, conventionally installed tuners, along with the method of attachment, and added drillings addressed by the present invention. This drawing also shows the flanged inserts, inserted in the top planer surface drillings, that reveal the inserted tuner shafts.
Figure 1A:
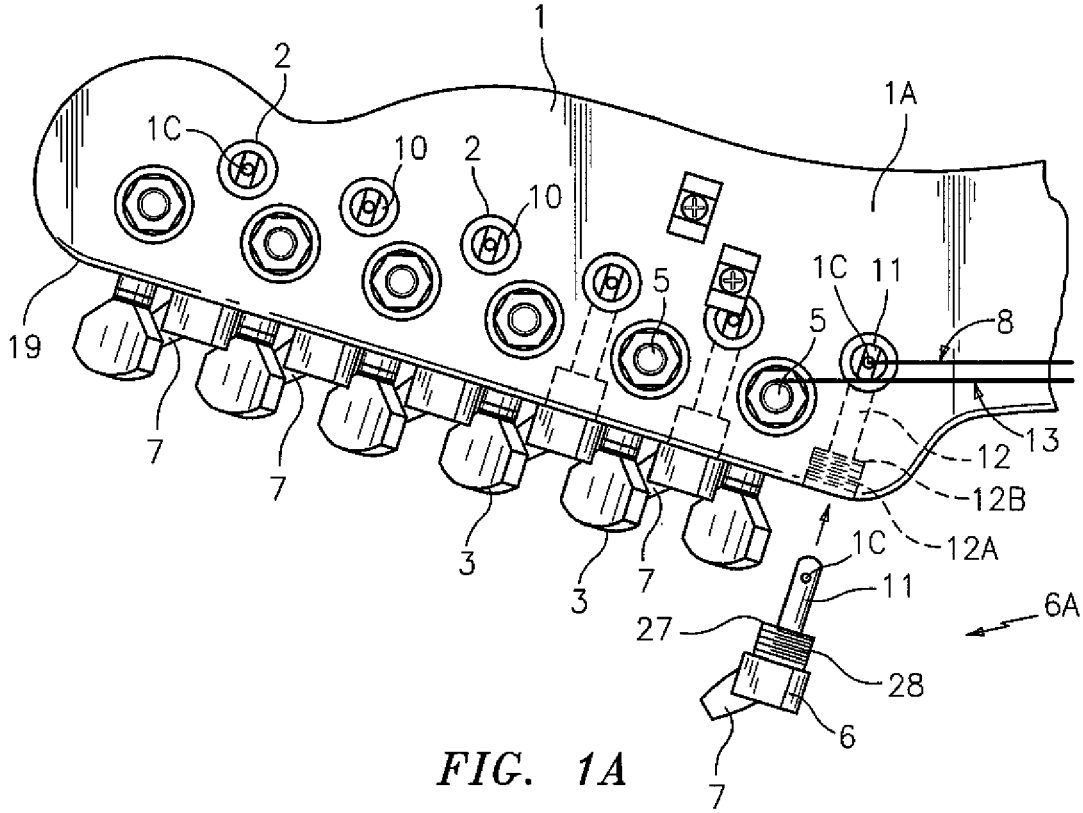

My invention will best be understood by a review of the detailed description of the preferred embodiment of the invention, in conjunction with FIGS. 1-4 of the drawings appended hereto, wherein like numerals refer to like parts throughout.

However, prior to turning to the figures, it should be understood that several preferred embodiments are disclosed below. For example, in a first preferred embodiment, the present invention is directed to a method of adding at least one more string to a stringed instrument having an initial plurality of strings and an initial plurality of tuners equaling the number of initial plurality of strings, wherein the stringed instrument comprises a headstock on which is disposed the initial plurality of tuners, a neck coupled to the headstock and a body coupled to the neck, wherein the body has a termination section mounted thereon, wherein each of the initial plurality of strings is at one end thereof coupled to a respective one of the initial plurality of tuners, extends over and along the neck and at the other end thereof is coupled to a termination section, wherein the headstock has a front surface, a rear surface and at least one side planer surface and at least one elongated bore in the side planer surface and wherein the headstock further comprises at least one individual aperture extending from the front surface to the rear surface of the headstock and the elongated bore extends perpendicularly to the aperture, wherein the method comprises the steps of inserting a steel flanged insert into the individual aperture; inserting a shaft, having a first end and a second end, in the elongated bore such that the first end of the shaft extends into the aperture of the headstock; coupling a first end of the at least one more string to the first end of the shaft and coupling a second end of the at least one more string to the termination section; and securing the shaft to the headstock; whereby the at least one more string extends over the body and along the neck, and the steel flanged insert prevents the at least one more string from direct contact with an edge of the aperture and facilitates an improved tone transfer to the headstock.

In a specific embodiment, a preferred embodiment comprises a method of converting an n-stringed instrument into a 2n stringed instrument, where n is an integer greater than 3 and less than 7, wherein the headstock comprises n elongated bores in the side planer surface of the headstock for each of the additional n strings to be added, and wherein the headstock further comprises n individual apertures each extending from the front surface to the rear surface of the headstock for each of the additional n strings to be added, and wherein each of the added elongated bores extend perpendicularly to each respective aperture and each of the additional n strings at one end is coupled to the respective shaft, wherein the method comprises the steps of inserting a steel flanged insert into each individual aperture; inserting a respective shaft in each elongated bore such that each respective first end of the shaft extends into the aperture of the headstock; coupling a first end of each additional string to a respective first end of the shaft and coupling a second end of the at least one more string to the termination section; and securing each shaft to the headstock; whereby each of the n additional strings extend over the body and along the neck, and each of the steel flanged inserts prevent the respective string from direct contact with an edge of the respective aperture and facilitates an improved tone transfer to the headstock.

In yet further specific embodiments, the present invention is directed to a method of adding the additional n strings by the steps of adding all of the respective number of additional shafts on the same side planer surface of the headstock.

Alternatively, the present invention is directed to a method of adding the additional n strings by the steps of adding only half of all the additional number of shafts on the same side planer surface of the headstock.

The present invention may also include the step of adjusting the string tension of the at least one more string after the step of attaching the at least one more string between the body and the first end of the shaft; wherein the adjusting of the string tension of the at least one more string comprises the step of turning an adjuster coupled to the second end of the shaft.

The present invention is also directed to an n stringed instrument, where n is an integer greater than 3 and less than 7, that has been modified to a 2n stringed instrument by the method of adding strings as set forth above and herein.

In a preferred embodiment, the instrument is a guitar.

The present invention, in an alternative preferred embodiment, is directed to a method of making an n-stringed instrument, where n is an integer greater than 3 and less than 7, comprising n tuners, a headstock on which is disposed the n tuners, a neck coupled to the headstock and a body coupled to the neck, wherein the body has a bridge mounted thereon, wherein each of the n strings is at one end thereof coupled to a respective one of n tuners, extends over and along the neck and at the other end thereof is coupled to a termination section, and wherein the headstock has a front surface, a rear surface and at least one side planer surface, and wherein the headstock has n elongated bores in the side planer surface and wherein the headstock further comprises n individual apertures extending from the front surface to the rear surface of the headstock and each respective elongated bore extends perpendicularly to its associated aperture, wherein the method of connecting each of the n strings to the headstock and the body comprises the steps of inserting a steel flanged insert into each individual aperture; inserting a shaft, having a first end and a second end, in each elongated bore such that the end of each respective shaft extends into its associated aperture of the headstock; coupling a first end of each respective string to the first end of the shaft and coupling a second end of each respective string to the termination section; and securing each of the n shafts to the headstock; whereby each of the n strings extend over the body and along the neck, and each respective steel flanged insert prevents its associated string from direct contact with an edge of the respective aperture and facilitates an improved tone transfer to the headstock.

Figure 2:
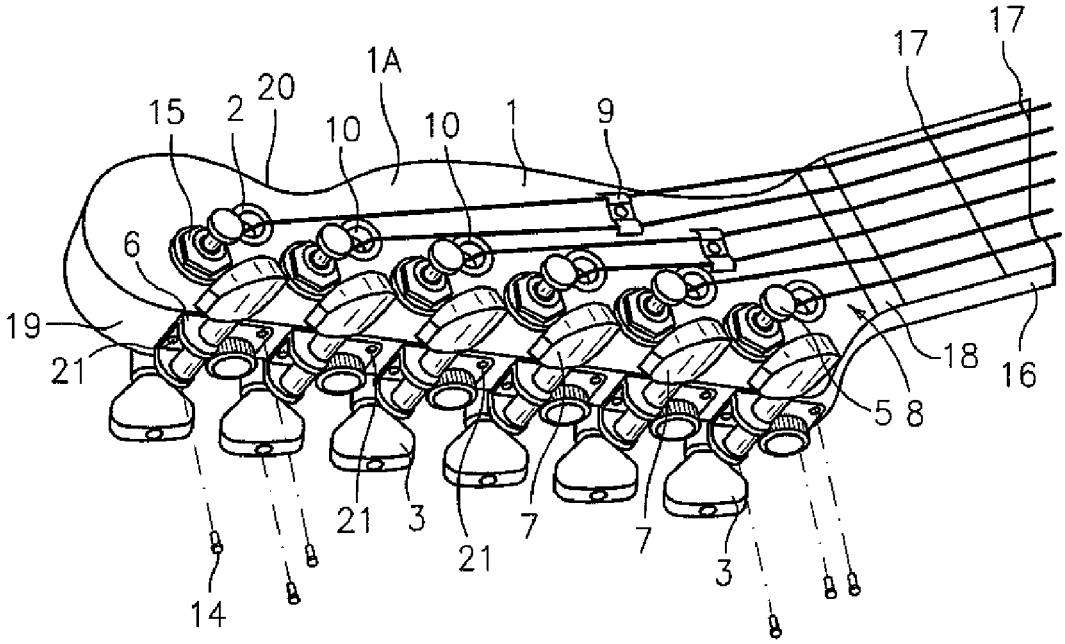
FIG. 2 is a top, angled view of both the top and side planer surfaces, of a slanted style, 6 tuners on one side, headstock. These are the two surfaces that facilitate the attachment method addressed in the present invention, and the tuners shown, as attached in this fashion. This drawing also shows the flanged inserts, as installed in the top planer surface, and the auxiliary string tensioning devices, and how the shown strings relate to these two devices.

Referring now to FIGS. 1, and 2, a stringed instrument headstock, 1 and it's top planer surface, 1A, is part of a stringed instrument neck 16. The neck has frets 17, and a nut 18, said nut is situated on the headstock end of neck 16, and used to guide strings 8, and 13 over, and to terminate on the aforementioned headstock's top planer surface 1A, and on to the tuner shafts 5, and 11.

The headstock 1, bridge/tailpiece 43, and nut 18, and their particular appointments, are the primary focus of the present invention (See FIGS. 1-25).

Figure 25:
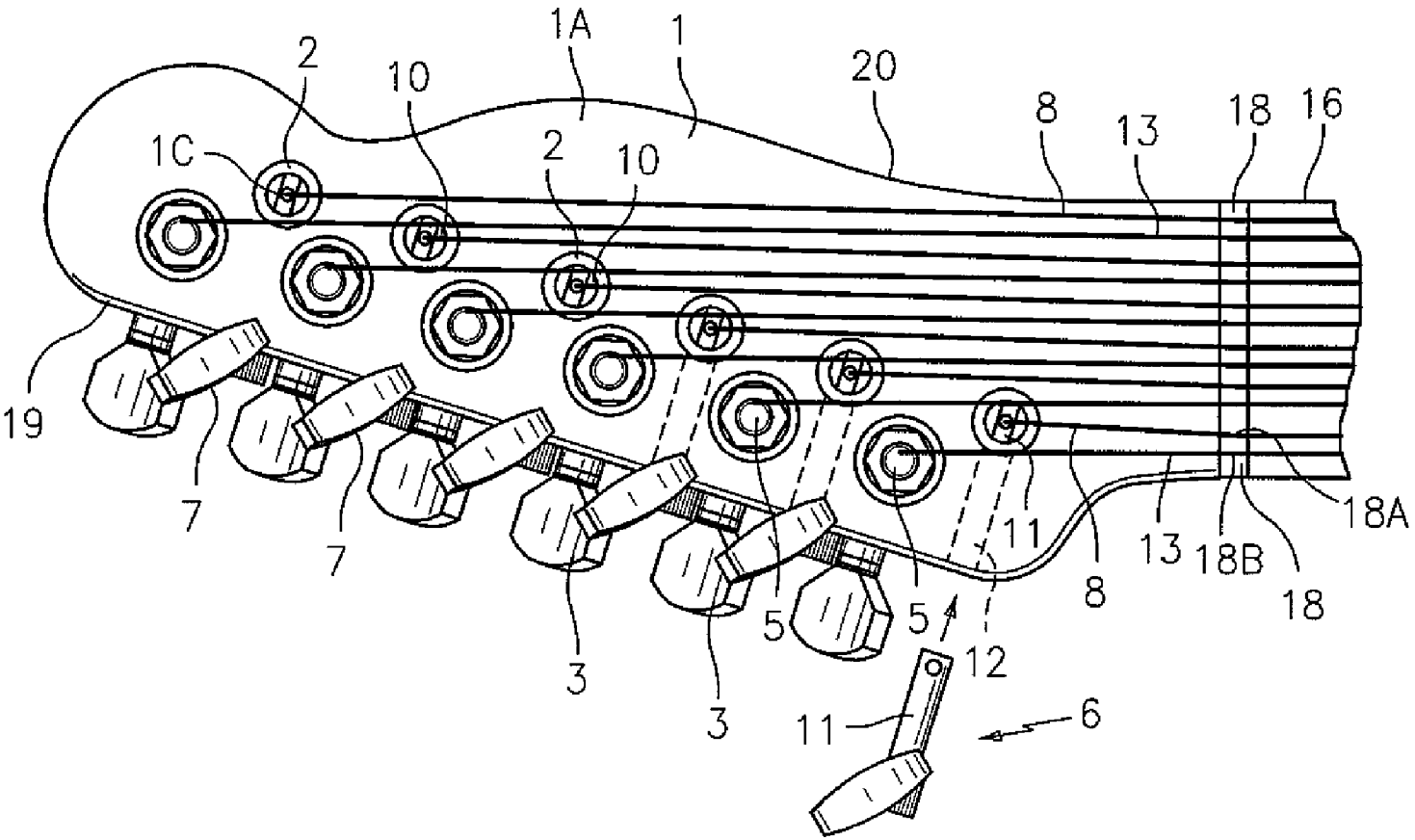
FIG. 25 is an illustration of the headstock of the guitar in FIG. 23 in accordance with the present invention.

The tuners that are supplied with any given stringed instrument 4, mounted through the rear planer surface 1B, of headstock 1, through factory supplied, stock drillings 25 (shown in FIG. 7), and onto the top planer surface 1A (see FIGS. 3,4), adjust the pitch of one, of a plurality of strings 13, (see FIGS. 1, 25). The string is attached to the shaft of the tuner 5, via it's perpendicular through bore ID (see FIGS. 4, 11) and pitch adjusted by manually, turning the adjusting button 3, attached to said tuner 4 attached to rear planer surface 1B, of headstock 1 (see FIGS. 2, 3, 25).

The present invention is the method of adding tuners, laterally into a shaft 12 (see FIGS. 1,3,4), predrilled in the side planer surface 19, (see FIGS. 1,3), of any stringed instrument headstock, allowing a paired string 8, to be utilized, usually, but not limited to, side by side with neighboring string 13, (see FIG. 1). Shafts 11, attached to said added tuners 6, are inserted into the predrilled, lateral shafts 12, on side planer surface 19, attached by, but not limited to this method of attachment, auxiliary screws 14, in registry, and inserted through holes 21, thereby fastening said tuners on side planer surface 19, and terminating in a predrilled perpendicular shaft 10, on the top planer surface 1A, of headstock 1, and accept attachment of musical instrument string 8, on tuner shaft 11, through it's perpendicular bore 1C, as it contacts steel flanged insert 2, allowing the pitch of string 8, to be manually adjusted by turning tuner tension adjustment button 7, (see FIGS. 1,2).

Figure 3:
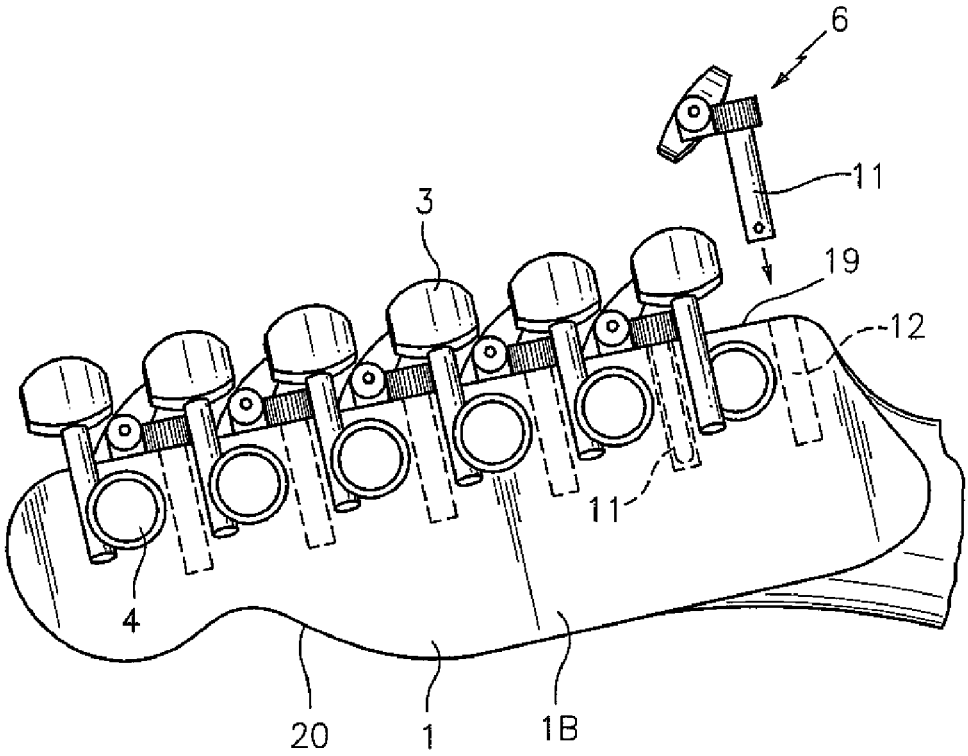
FIG. 3 is a view of the rear planer surface of a typical slanted style, 6 tuners on one side, headstock. This view shows the typical, stock, factory supplied tuners, and the attachment of the tuners, and the added drillings referenced, as addressed in the present invention.
Figure 4:
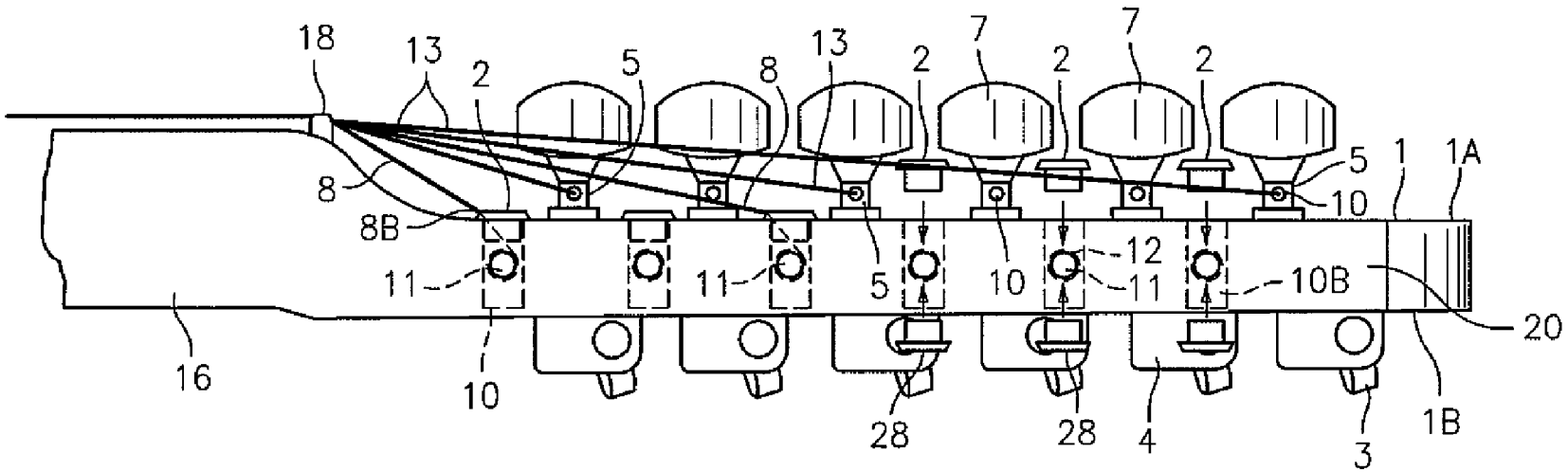
FIG. 4 is an opposing, side view to the view perspective of FIG. 2, showing the added drillings, and the flanged inserts installed, in addition to the stock, and retrofitted tuners, as addressed in this invention. Additionally

Looking now at FIG. 4, an opposing lateral view, to side planer surface 19 (see FIGS. 1,2, and 3), this side, 20, can be a planer surface, or as in this case is obliquely radiused, as is illustrated in FIGS. 1, 2, and 3. Back to FIG. 4, this stringed instrument headstock opposing view, with surface 20 in view, shows the perpendicular predrilled shaft 10, lateral predrilled shaft 12, steel flanged insert 2, and tuner shaft 11, as it resides in lateral shaft 12.

Figure 5:
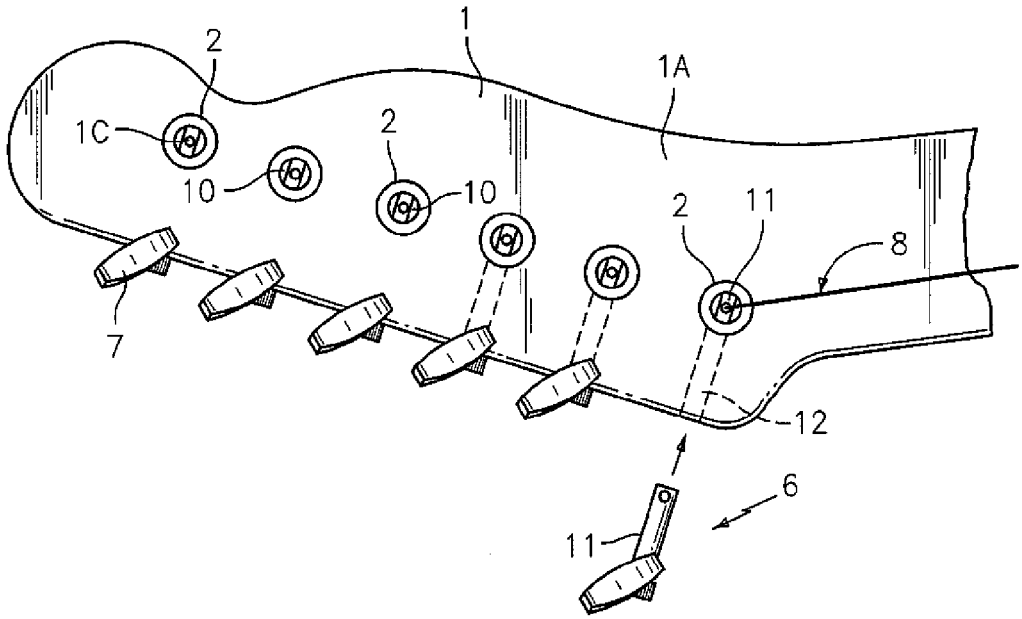
FIG. 5 is a view of the top planer surface of a typical slanted style, 6 tuners on one side headstock, showing only the tuners attached, as addressed in the present invention, as a stand alone installation, also shown are the perpendicular drillings, capped by the flanged inserts, facilitating the aforementioned method of attachment, otherwise identical to FIG. 1.
Figure 6:
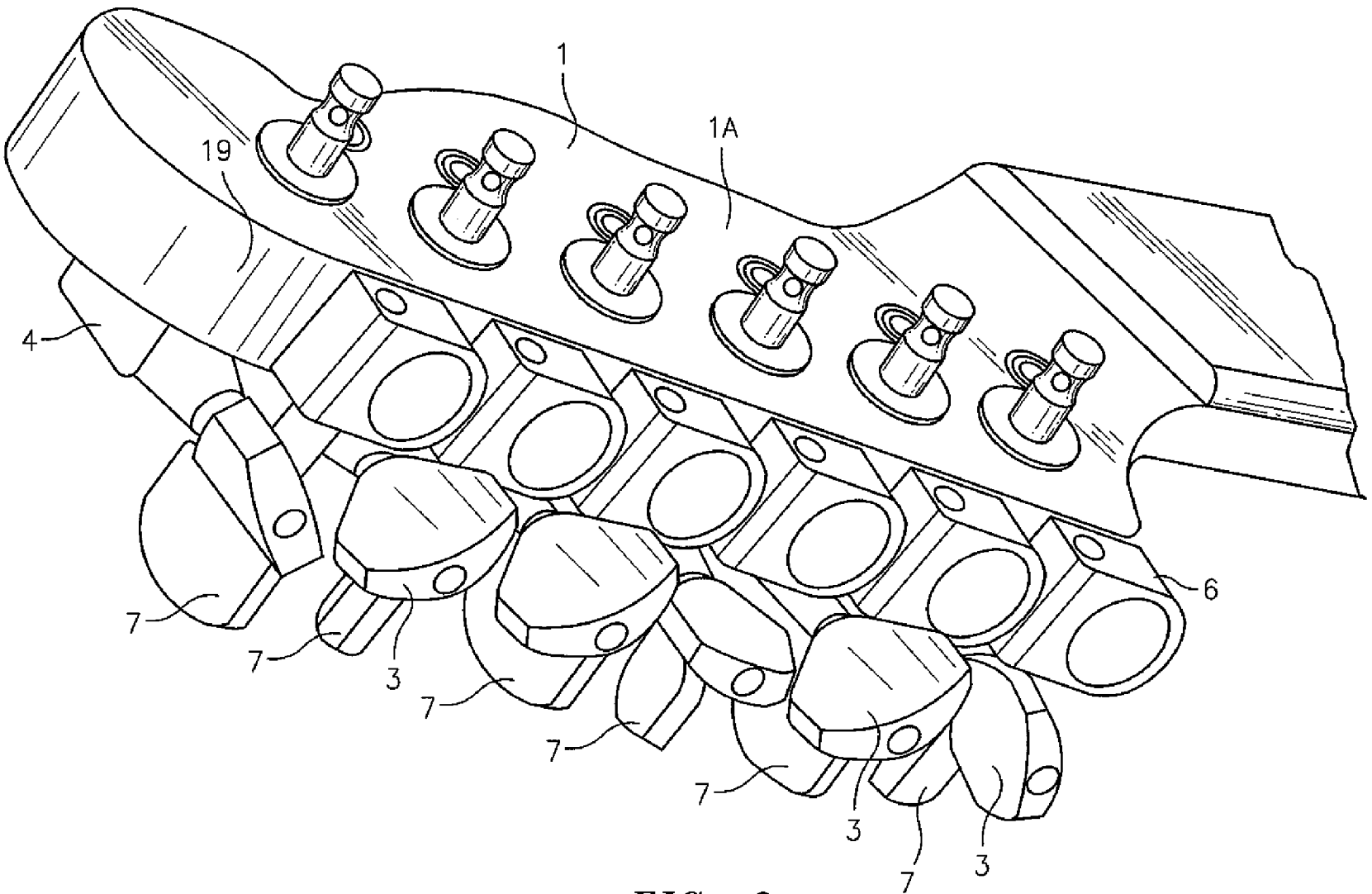
FIG. 6 illustrates the added, attached, tuners using the means of attachment in the present invention, pointing downward through the stock, conventionally mounted tuners, and their adjustment buttons.
Figure 7:
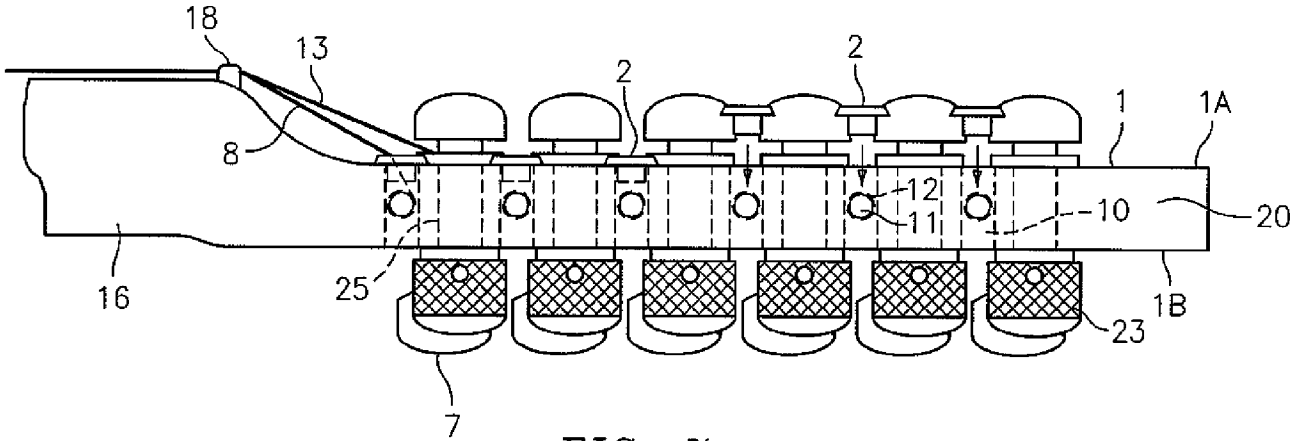
FIGS. 7, 8, and 9 shows the ability to use a variety of vertically installed tuners, in place of the conventionally mounted, stock tuners, in their factory drillings, in concert with the tuners added in the present invention. Illustrated are the Steinberger gearless tuners, LSR tuners, and geared banjo tuners.

FIGS. 2, and 3 show auxiliary string tension devices 9. FIGS. 5, 6, and 7, illustrate this method of attachment, described herein, as a stand alone, non-paired, single-string installation, on a stringed musical instrument headstock.

Now looking at FIG. 4, illustrating the union of string 8, and flanged steel insert 2, as being 8-B, affording a direct string/headstock contact, for a more desirable tone transfer to the headstock 1, its top planer surface 1A, and sonic superiority, over the conventional union of string 13, to post 5, as shown. FIG. 4, additionally shows steel flanged insert 2-B, and it's insertion into drilling 10-B, not as a blind drilling as in 10, but as a through drilling, and as an optional method to access string for trimming.

Now we come to FIG. 1-A, which is an illustration of alternative means, with the present invention, to attach a sealed tuner 6-A, to side planer surface 19, drilling 12-B is added to drilling 12, and threads 12-A, are added to drilling 12-B, to accept added threads 28, on tuner barrel 27, and tuner barrel 27, can now be press fit into, threadably attached, or with various adhesives, bonded into shaft 12-A, making auxiliary screws 14 (see FIG. 2), optional, and not needed for the installation, or attachment.

FIG. 5, depicts top view of headstock 1, and it's top planer surface 1A, with the present invention as a stand alone installation, with string 8, as it glides over flanged insert 2, and attaches to inserted tuner shaft 11, via its perpendicular bore 1C.

FIG. 6, shows the method of attachment in the present invention, and having those tuners 6, attached to side planer surface 19, and having tuner buttons 7, pointing downward through the conventionally mounted, stock tuners 4, and their adjustment buttons 3.

FIG. 7, shows the vertical steinberger gearless tuners 23, installed in the stock tuner drillings 25, accepting string 13, working in conjunction with the tuners 6, not shown (adjustment buttons 7, shown), installed using the method in the present invention.

Figure 8:
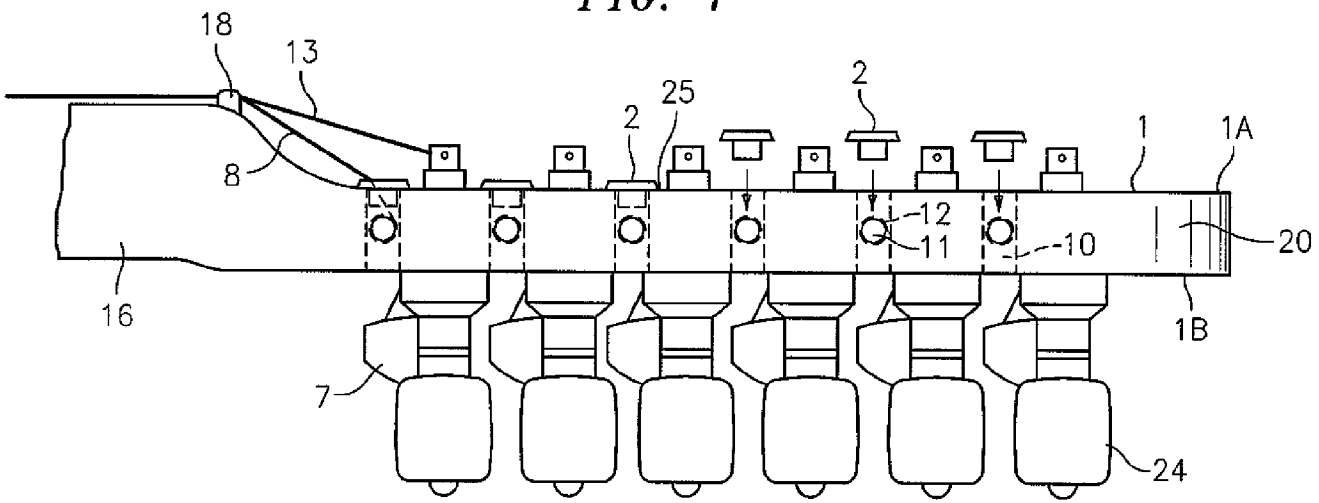

FIG. 8, shows the installation of geared banjo tuners 24, installed in the stock factory tuner drillings 25, working in conjunction with the tuners 6, not shown, adjustment buttons 7, (shown), installed using the method of attachment addressed in the present invention.

Figure 9:
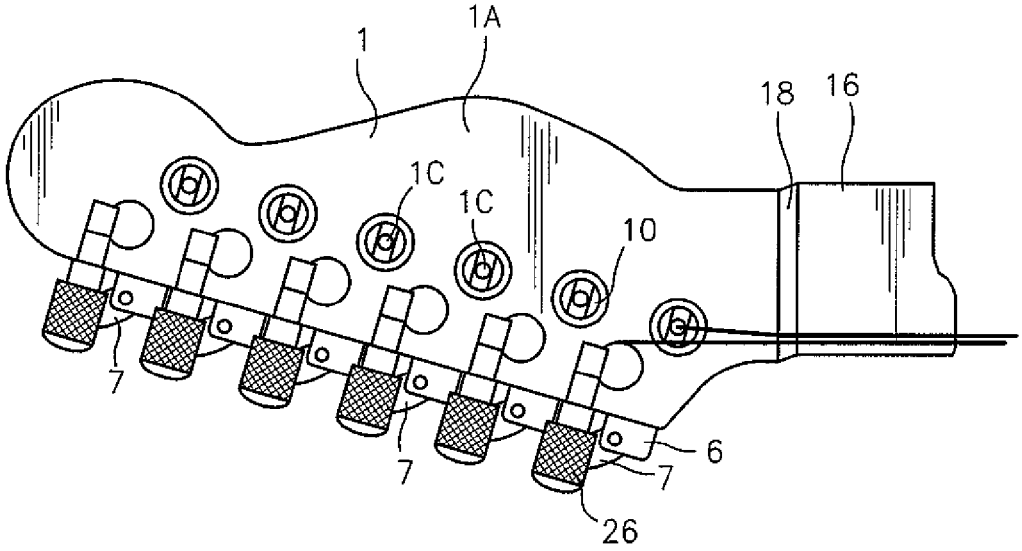

FIG. 9, illustrates the usage of the LSR, laterally adjusted tuners 26, installed in the stock, factory drillings 25 (see FIGS. 7, 8, 9), working in conjunction with the tuners 6, using the means of attachment addressed in the present invention.

Figure 10:
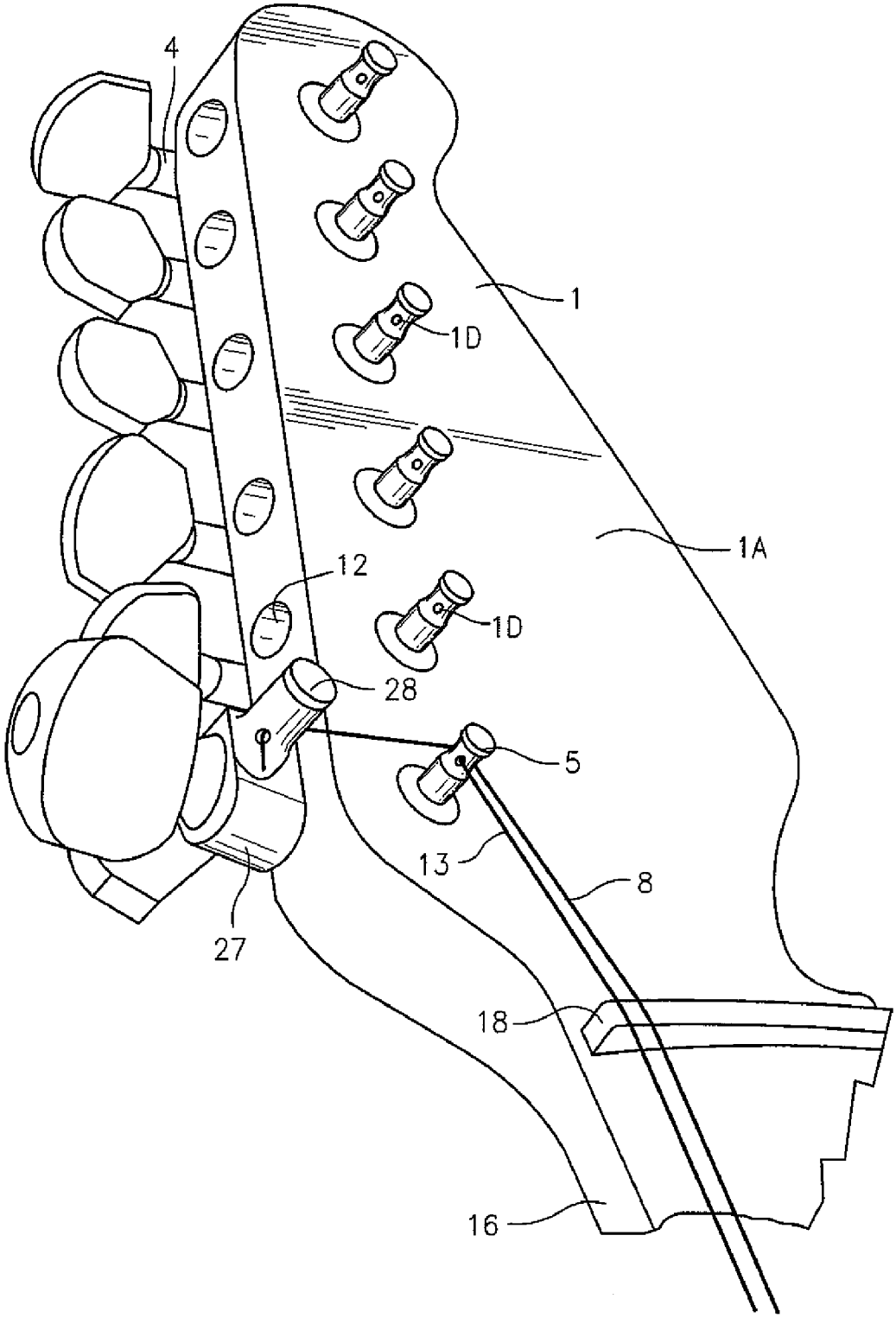
FIG. 10 shows the ability to use $5^{th}$ string banjo pegs, in the added lateral drillings 12, used in the present invention, to work in concert with the conventionally mounted, stock tuners.

FIG. 10, shows the installation of a "5$^{th}$ string" banjo tuner, installed in the lateral drilling 12, provided in the present invention, on the side planer surface 19, string 13, being attached to tuner post 5, of the stock tuner 4, and string 8, goes around post 5, and onto post 28, on tuner 27, thus, working in conjunction with the stock, factory installed tuners.

Figure 11:
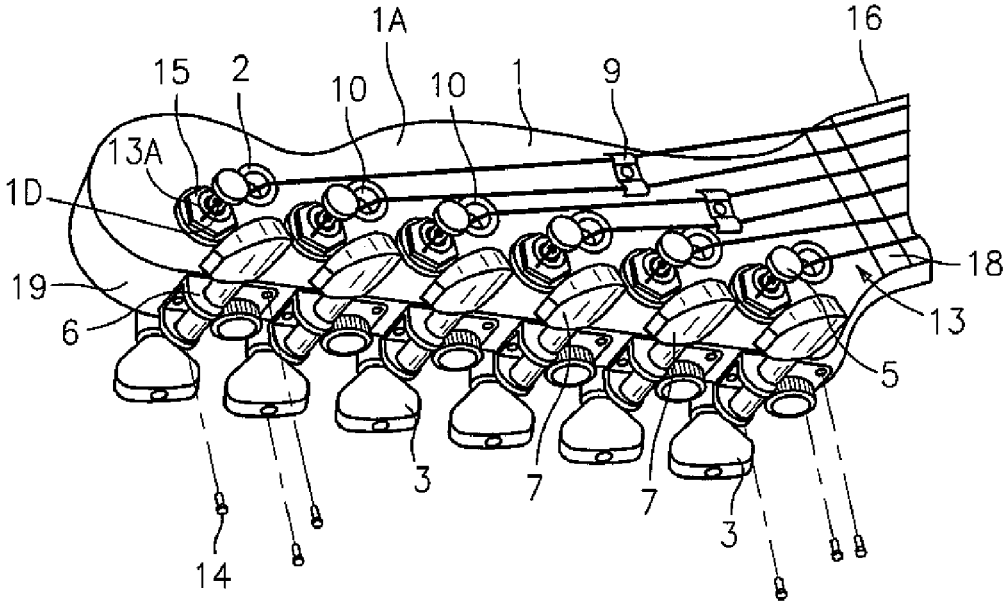
FIG. 11 shows when used with the conventionally mounted tuner post 5, the angle of the string as it travels over its guide (nut) 18, and onto the tuner post termination 5, as lessened by the auxiliary string tension retainers 9, thereby adding tension, and the need for them, to add this tension.

FIG. 11 shows string 13, and the need for ancillary string tension retaining devices 9, attached to top planer surface 1A, of headstock 1, with the conventionally installed tuner posts 5, due to their height, in relation to the string guide (nut) 18.

Figure 12:
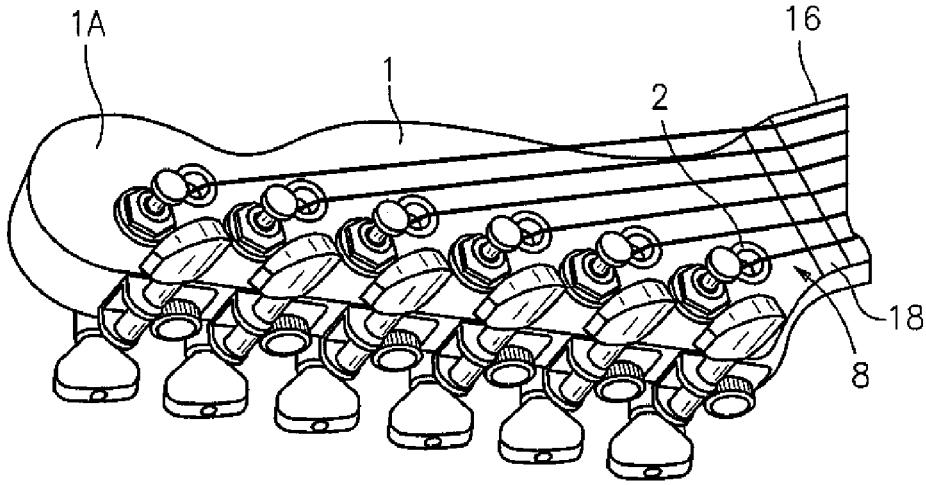
FIG. 12 illustrates that when using the means of tuner attachment, as used in the present invention, there is no need for these auxiliary string tension retainers shown in FIG. 10, due to the greater angle of departure of the string, over it's guide (nut), and into it's much lower termination into the provided drilling, and onto the tuner shaft.

FIG. 12, as compared to FIG. 11, shows the method of attachment in the present invention, and the more acute angle of string 8, and it's lower attachment point over flanged insert 2, and onto shaft 11 (not shown), in relation to the string guide (nut) 18, making a more secure, and rattle free installation, and does away with the need for ancillary string tension devices 9, attached to headstock 1, and it's top planer surface 1A, as shown on FIG. 11.

Figure 13:
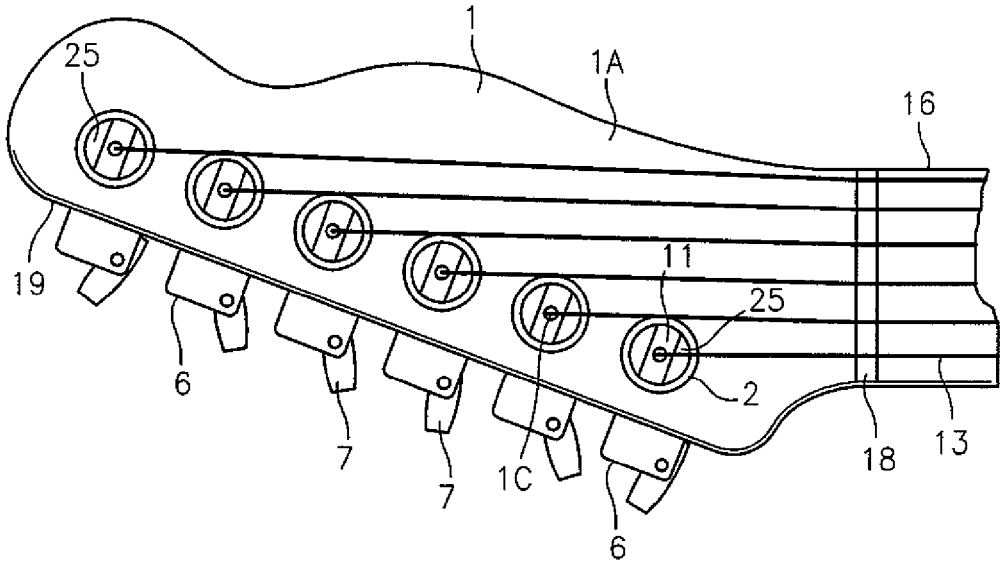
FIG. 13 illustrates a stand alone installation using the means of attachment in the present invention, and the stock tuner drillings, and flanged inserts, to access the tuner shafts, added in the present invention.
Figure 14:
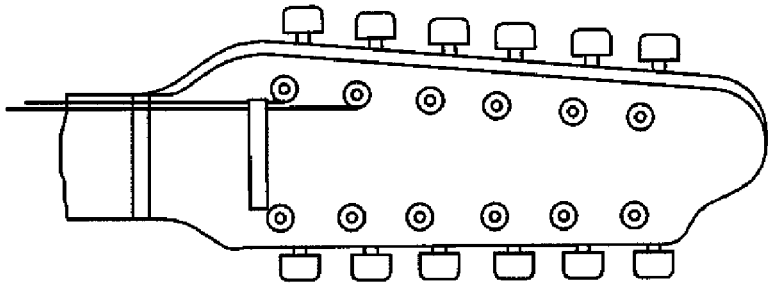
FIG. 14 (PRIOR ART)
FIG. 14 as prior art, is the Fender Telecaster 12 headstock/tuner attachment.
Figure 15:
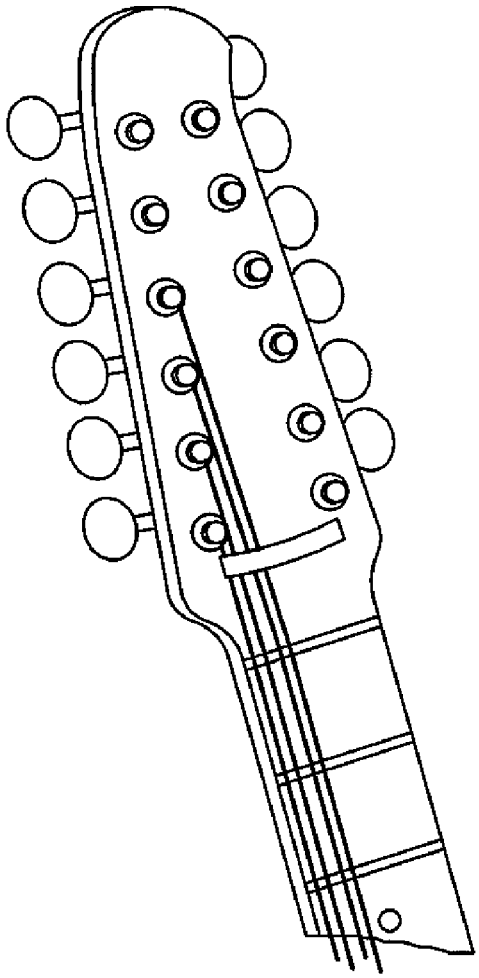
FIG. 15 (PRIOR ART)
FIG. 15 as prior art, is the Fender Stratocaster X11 headstock/tuner attachment.
Figure 16:
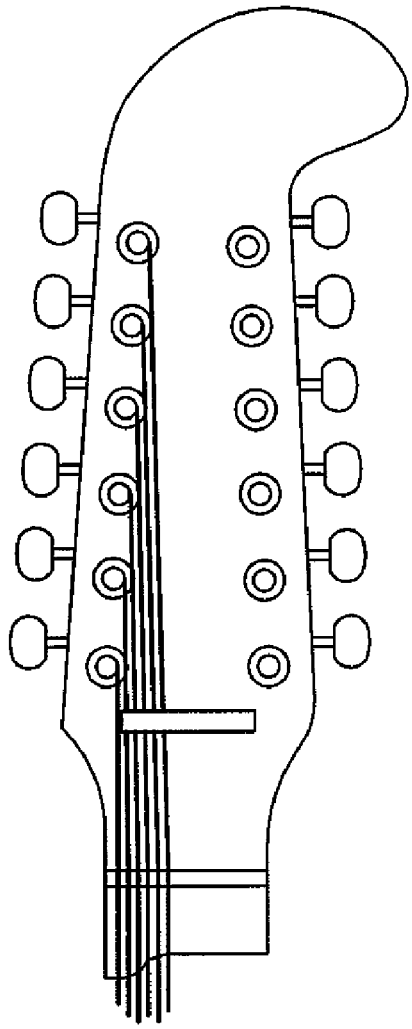
FIG. 16 (PRIOR ART)
FIG. 16 as prior art, is Fenders "hockey stick" headstock/tuner attachment.
Figure 17:
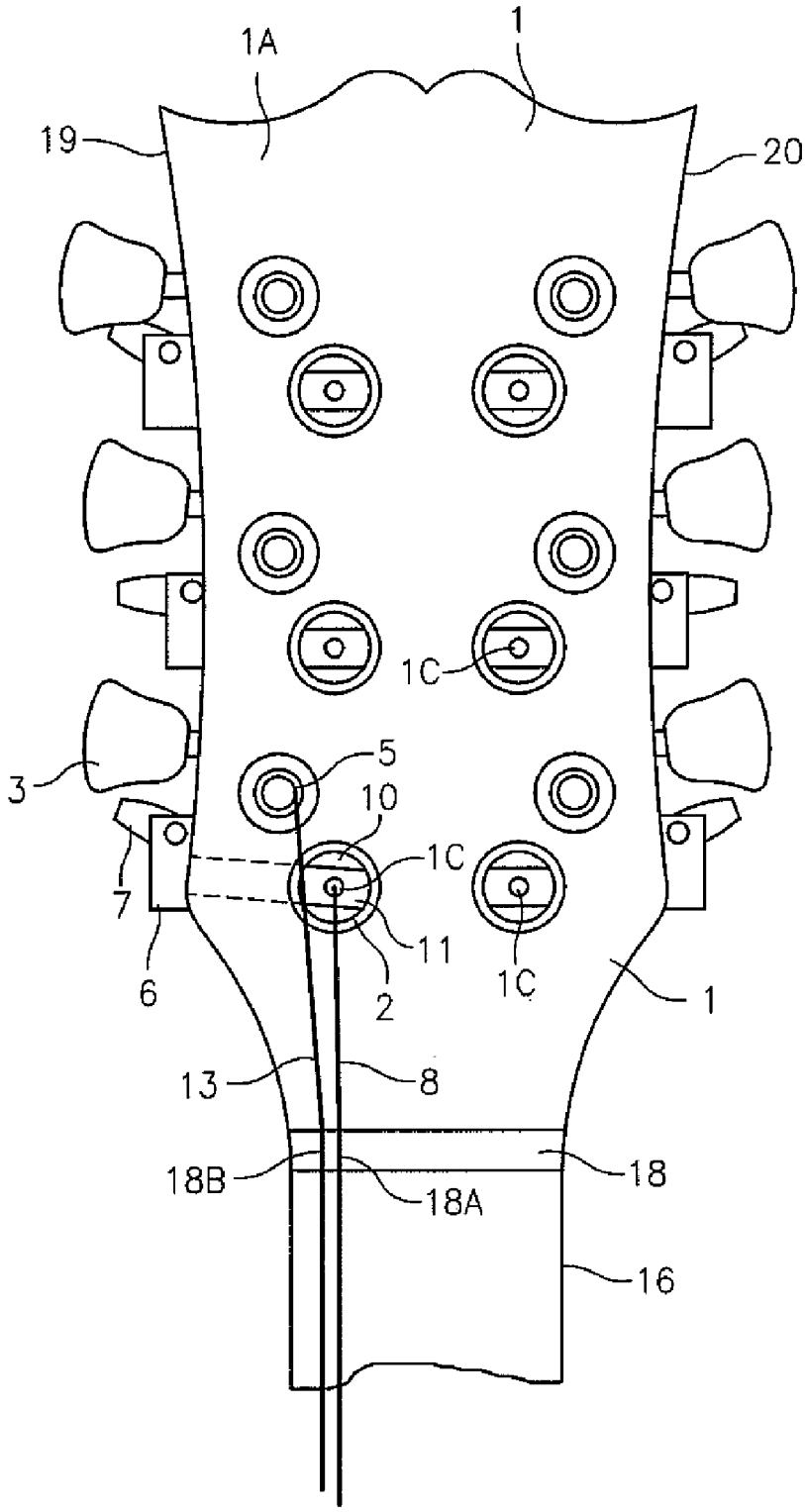
FIG. 17 as prior art, is a 6 string version of FIG. 18, with their 6 tuners attached conventionally, as in their 12 string headstock, and how it may be transformed from 6 to 12 strings, using the means of attachment in the present invention.
Figure 18:
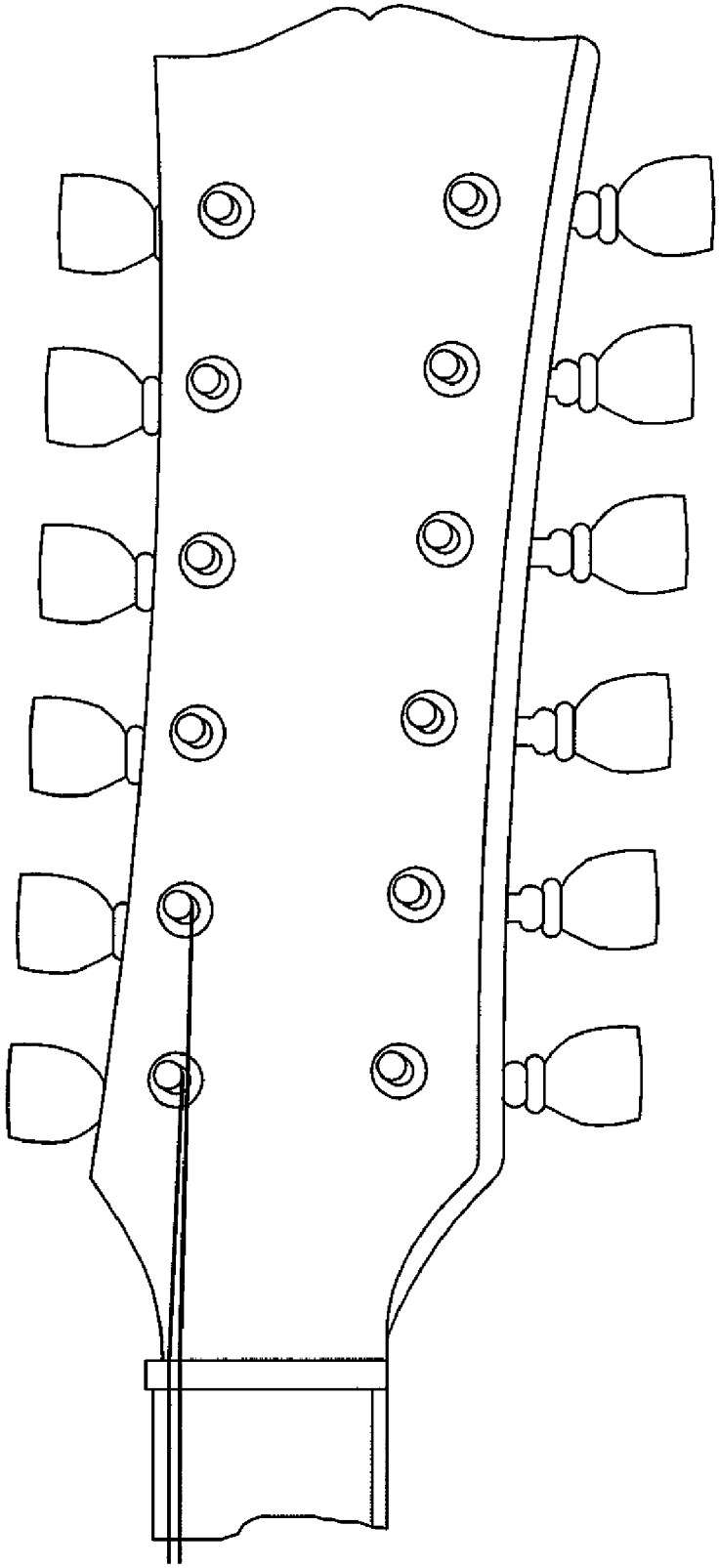
FIG. 18 (PRIOR ART)
FIG. 18 as prior art, shown full size, is the 12 string version of FIG. 17, and the size differential needed, with their attachment means, to create a 12 string instrument.

FIG. 13, illustrates the attachment method used in the present invention, and its tuners 6, installed on side planer surface 19, using the stock, factory tuner drillings 25 (see FIGS. 7, 8, 13), and the attachment of string 13, over string guide (nut) 18, over installed flanged insert 2, and onto shaft 11, via it's perpendicular through bore 1C, as a stand alone installation.

FIGS. 17, and 18, 6 and 12 string respectively, rectangular style headstock, the size differential, and how the standard headstock 18, could benefit from the method of attachment in the present invention.

Figure 24:
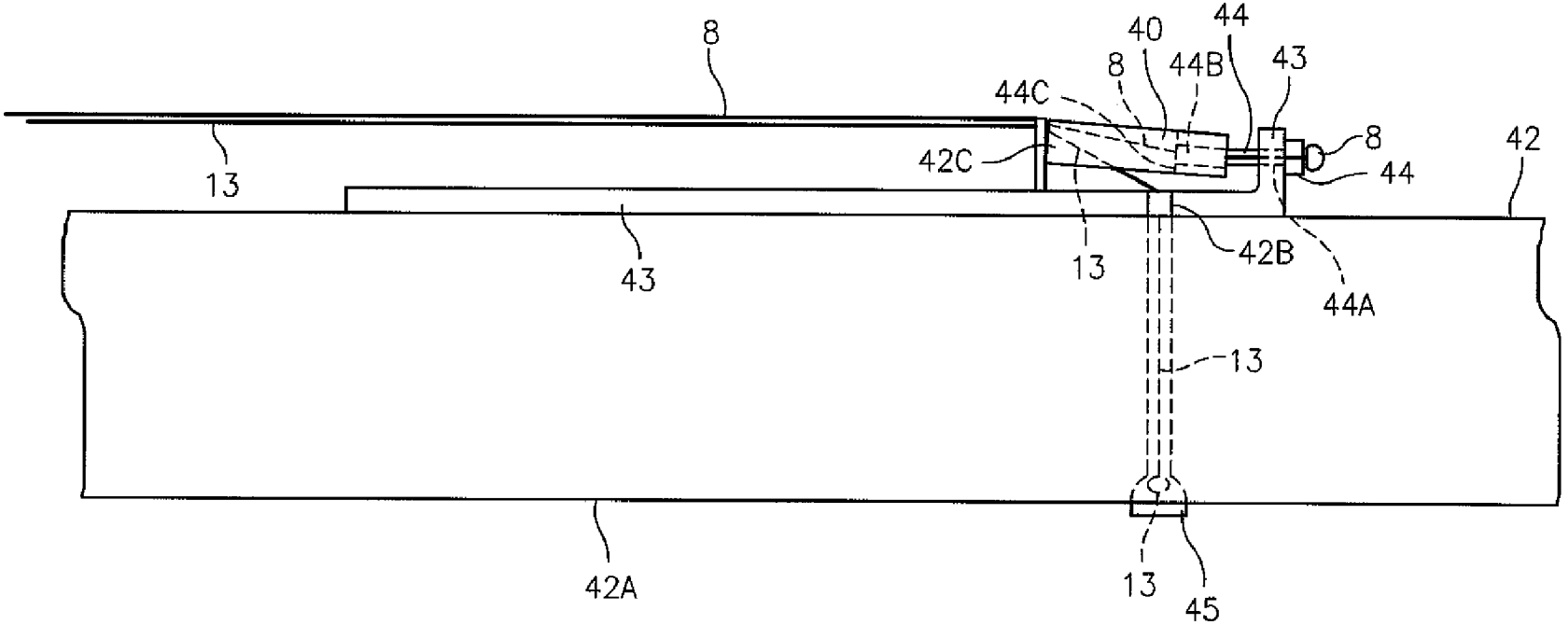
FIG. 24 is a cross section of a part of FIG. 23.

As shown in FIG. 24, I have developed, bridge modifications that are needed to accommodate the one or more added string. Also will be addressed the needed modifications to the nut 18 (see FIG. 25), and this will follow the detailed description of the bridge/tailpiece modifications. The bridge shown is for illustration only and is not meant to limit the scope of the present invention to any one particular bridge type, as all can be modified, also there are aftermarket saddle systems such as the Gotoh 12 string bridge, that can be used in conjunction with these modifications that allow the added string(s) to be individually adjusted, as to length. The modifications are as follows: The bridgeplate/tailpiece 43, being attached to top planer surface of guitar body 42, contains one or more saddles 40, and one or more intonation, adjustment screws 44. Contained in said modification is one or more drilling 44A, through the rear lip of the bridgeplate/tailpiece 43, that are enlarged, to accommodate larger intonation adjustment screw 44, said screw 44, has a longitudinal bore 44C, added to it, saddle 40, and it's rear drilling are resized and tapped to accept new, hollow bored, intonation adjustment screw 44, string 8 is threaded through, new hollow screw 44, it travels through saddle 40, via it's elongated, through bore 42*c*, and over front edge of saddle 40, with two equidistant grooves added (not shown) to separate, and guide strings 8, and 13, to (now see FIG. 25), and in substantial registry with nut 18, and its added, and existing slots/grooves 18B, and 18A, (now FIG. 23) across body 42, over neck 16, over the nut 18, onto the headstock 1, over flanged steel insert 2, in top planer surface 1A, and on to shaft 11, via its perpendicular bore 1C (see FIG. 25). (Back to FIG. 24), string 13 takes the path it originally took, and is anchored in ferrule 45, residing in the rear planer surface of the guitar body 42A, up through said body, through bridgeplate/tailpiece access hole 42B, and through saddle 40, via its elongated, through bore 42*c* (string 13, now shares said saddle 40, with string 8), and over front edge of saddle 40, said string 13, now travels across the body 42, (now see FIGS. 23,25), over the neck 16, over the nut 18, onto the headstock 1, and on to shaft 5, situated on top planer surface 1A.

In the preceding detailed description of the bridge modifications unique to the present invention (now see FIG. 25), also alluded to are the modifications to the nut 18, the added string, or existing string(s) 8, or 13 (all depending on if the user wants the primary string, or octave string first, or second in line), must have, and are as follows: a new slot(s)/groove(s) 18B, cut in said nut 18, equadistant from existing slot/groove 18A, and any additional slots/grooves cut. This/these slot(s)/groove(s) to guide string(s) must be added, commensurate with the number of strings added, one string added, one added slot/groove etc. FIG. 25 also shows 6 added slots/grooves 18B, and 6 existing slots/grooves 18A, in nut 18, equaling a 6 to 12 string conversion in a slanted, 6 tuners on one side headstock with the additional tuners 6, added using the method/means in the present invention, in conjunction with the aforementioned unique bridgeplate/tailpiece modifications, in addition to the needed nut modifications.

As has been indicated, 12 string guitars, and various attachment methods for tuners, to headstocks of said guitars, have been well known, and most sought after, in the musical arts, and produce a tone with its "jangle" like no other stringed instrument. The problem with the prior art is that most all the headstocks have, or had to be, large, cumbersome, nondescript, stylistically devoid, and virtually doubled in size, just to be able to accommodate the additional tuners, purpose driven to that end, and far removed stylistically, from their 6 string headstock counterpart, which contains the iconic characteristic most any manufacturer is identified with as their mark in the industry, or the only other viable alternative, was to have two large slots cut in the headstock, to provide access to the additional tuners. Not one of these aforementioned methods can be performed on a slanted style, 6 tuners on one side, stringed instrument headstock, aftermarket, or new construction, additionally, the aforementioned large slots, would be impossible to perform on a slanted style, 6 tuners on one side headstock before, or aftermarket. The present invention can be done on any headstock, as an aftermarket conversion, as new construction, as an ancillary addition to an existing set of tuners, as a stand alone installation, can be faced either up, or down, sold as a kit for do it yourself installation, and most desirable, sold as an already converted neck, ready to use as needed. As stated, although this attachment method will work on any headstock, it is particularly useful on the slanted style, 6 tuners on one side headstock.

As can be seen, the preferred embodiments of the present invention provide methodologies of attaching tuners, to any stringed musical instrument headstock, and particularly for use in conjunction with stringed musical instruments having the slanted style, 6 on one side tuner arrangement. This method of attachment encompasses the headstock of a stringed musical instrument, and the lateral insertion of tuners into said headstock. The tuner shafts are inserted in predrilled shafts on a side planer surface of the headstock, and are in substantial registry with predrilled shafts on the top planer surface of the headstock, that accept flanged inserts, thus protecting the circumference of said predrilled shafts, and providing an indestructible surface for the musical instrument string to slide over, and on to the tuner shaft. The operator can now adjust these tuners as he would any conventionally installed tuner. These tuners, installed by this method, can be used in conjunction with the factory supplied tuners to convert the instrument to a double strung instrument, usually a 12 string, or can stand alone as a sonically superior method of tuner attachment for the primary array of strings, usually 6.

Figure 19:
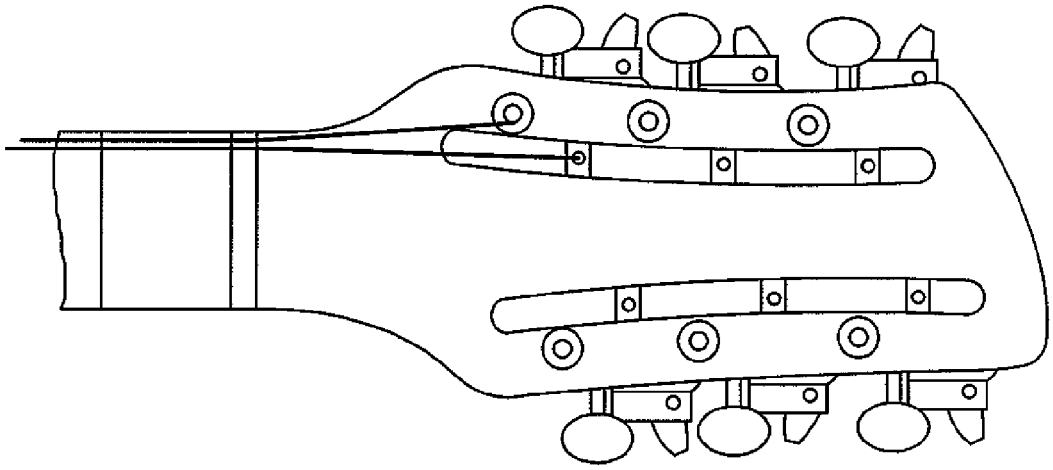
FIG. 19 (PRIOR ART)
FIG. 19 as prior art, is the Rickenbacker/Duesenberg style headstock/tuner attachment.
Figure 21:
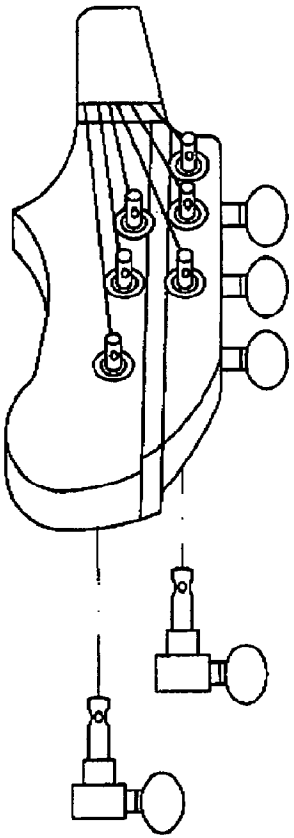
FIG. 21 (PRIOR ART)
FIG. 21 as prior art, is the Burrell style headstock/tuner attachment.
Figure 20:
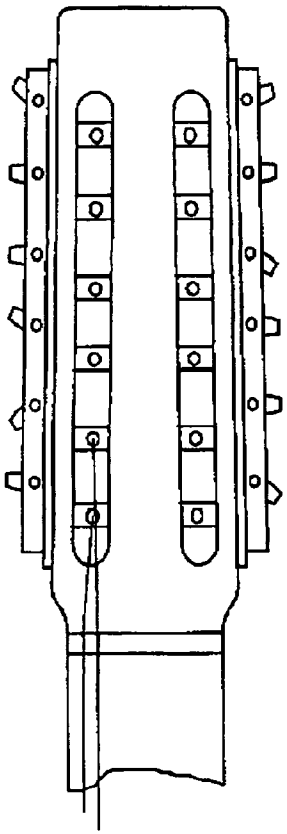
FIG. 20 (PRIOR ART)
FIG. 20 as prior art, is the Martin/classical style headstock/tuner attachment.
Figure 22:
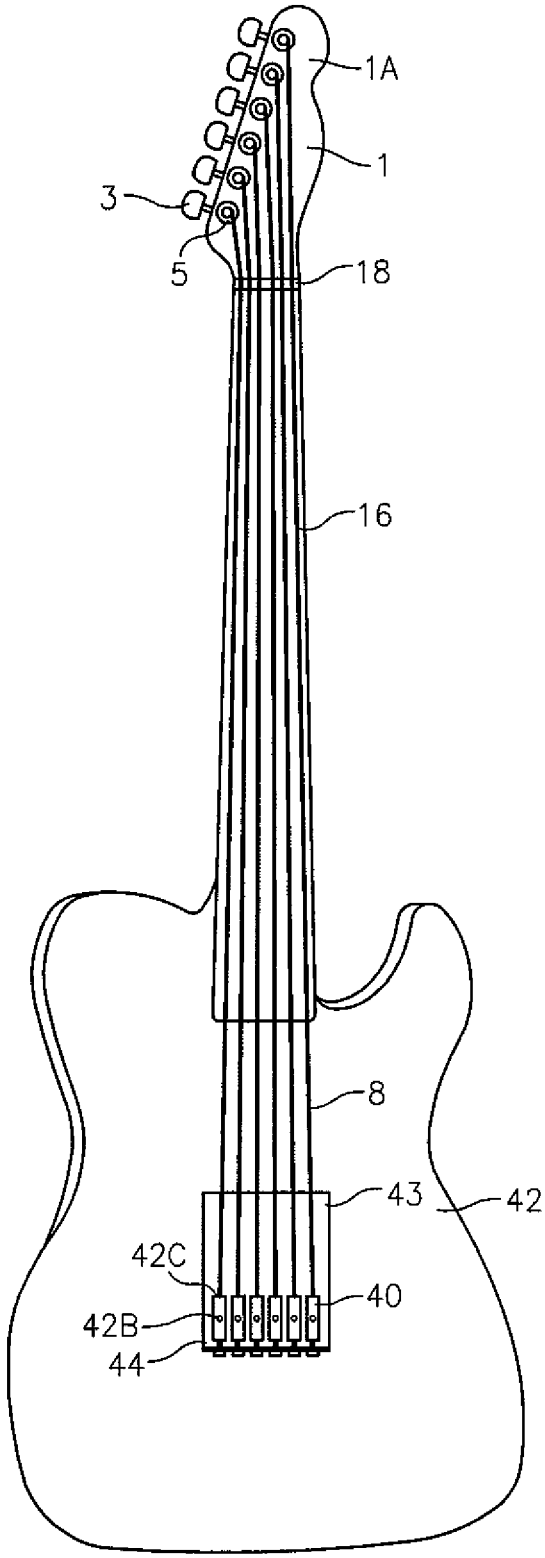
FIG. 22 PRIOR ART)
FIG. 22 as prior art, illustrates a full 6 string guitar prior to modifications in accordance with the present invention.
Figure 23:
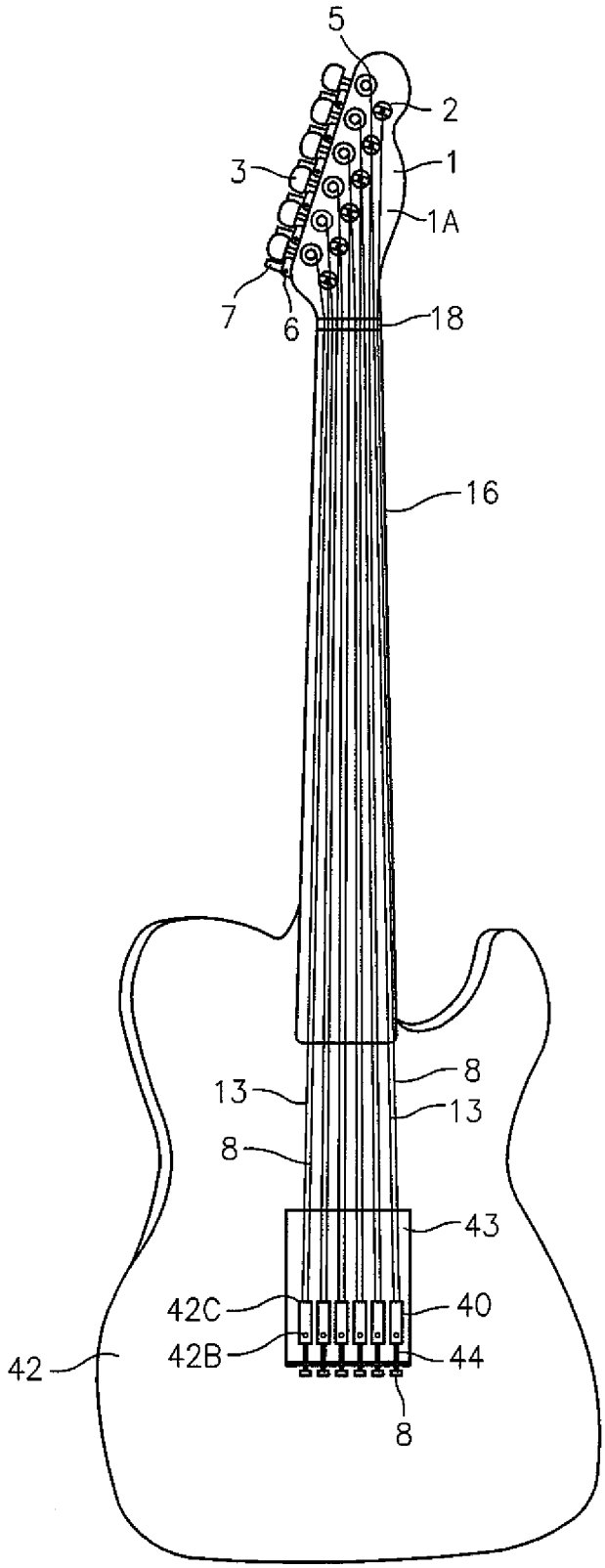
FIG. 23 illustrates a 6 string guitar that has been modified to a 12 string guitar in accordance with the present invention.

Additionally, the present invention provides improvements of attachment for tuners to a stringed musical instrument headstock, both sonically, and logistically, over the method used in FIGS. 19, and 20. For example and by way of example and not limitation, the present invention provides for: (i) direct contact of string with the headstock through added steel flanged insert, facilitating a direct tone transfer, thereby improving the sonic signature of any given added string; (ii) use on virtually any style headstock manufactured; (iii) use on virtually any existing headstock, aftermarket, leaving the original finish intact, and untouched; (iv) use on virtually any headstock, and is particularly useful as the only way attach additional tuners to a slanted style, 6 tuners on one side headstock where large, routed slots would be impossible to add due to space limitations, the angle string would cross tuner shaft wouldn't work, and top surface angle/dip of headstock would make routing said slot impossible, and in addition the finish would be destroyed in an aftermarket application; and (v) attaching tuners using the method in the present invention, aftermarket, or new manufacture, barely a thimble full of wood is removed, being minimally invasive, and retaining the intended structural integrity of any given headstock.

It should also be understood that the tuner turns the string, thereby adding, or subtracting tension, this is done typically by a button attached to a shaft that terminates into a worm gear, and that worm gear is in registry with a round, toothed gear that is attached to the circumference of the first end of shaft 11, whereby the second end of said shaft 11 accepts attachment of one string, and the attached string's tension is maintained by the friction, and high ratio of the interlocking of these two gears.

Moreover, it should be understood that the particular sequence of steps are not required to be performed in any particular order unless specifically set out in the specification or the claims.

As can also be seen, the present invention provides for the usage of a plurality of tuners, said tuners usually consisting of a body, an adjustment button, two gears, and a shaft which is referenced by number 11 in the figures, the shafts of which, are laterally inserted into newly provided drillings on a side, planer surface of the stringed musical instrument headstock, and those newly provided drillings, being in registry with newly provided, perpendicular, drillings 10 on the top, planer surface of said stringed musical instrument headstock, these newly provided, perpendicular, drillings on the top, planer surface of the stringed musical instrument headstock, are provided with a flanged insert 2 around the circumference of said drilling that provides a guide for any given string, as it continues on to, and terminates to the laterally inserted tuner shaft 11, and is preferably attached to the shaft 11 through aperture 1C, and is manually tuned to taste, increasing, or decreasing the tension as desired, via the supplied adjustment button, as a conventionally mounted tuner would be, thereby, making possible, the addition of tuners to any stringed musical instrument headstock, and more particularly the slanted style, 6 tuners on one side, stringed musical instrument headstock.

Although there have been described particular embodiments of the present invention of a new and useful method for attaching tuners to a guitar headstock, it is not intended that such references be construed as limitations upon the scope of this invention except as set forth in the following claims.

What is claimed is:

1. A method of adding at least one more string to a stringed instrument having an initial plurality of strings and an initial plurality of tuners equaling the number of initial plurality of strings, wherein the stringed instrument comprises a headstock on which is disposed the initial plurality of tuners, a neck coupled to the headstock and a body coupled to the neck, wherein the body has a termination section mounted thereon, wherein each of the initial plurality of strings is at one end thereof coupled to a respective one of the initial plurality of tuners, extends over and along the neck and at the other end thereof is coupled to a termination section, wherein the headstock has a front surface, a rear surface and at least one side planer surface and at least one elongated bore in the side planer surface and wherein the headstock further comprises at least one individual aperture extending from the front surface to the rear surface of the headstock and the elongated bore extends perpendicularly to the aperture, wherein the method comprises the steps of:

inserting a flanged insert into the individual aperture;

inserting a shaft, having a first end and a second end, in the elongated bore such that the first end of the shaft extends into the aperture of the headstock;

coupling a first end of the at least one more string to the first end of the shaft and coupling a second end of the at least one more string to the termination section; and securing the shaft to the headstock;

whereby:

the at least one more string extends over the body and along the neck, and the flanged insert prevents the at least one more string from direct contact with an edge of the aperture and facilitates an improved tone transfer to the headstock.

2. A method of converting an n-stringed instrument into a 2n stringed instrument, where n is an integer greater than 3 and less than 7, wherein the headstock comprises n elongated bores in the side planer surface of the headstock for each of the additional n strings to be added, and wherein the headstock further comprises n individual apertures each extending from the front surface to the rear surface of the headstock for each of the additional n strings to be added, and wherein each of the added elongated bores extend perpendicularly to each respective aperture and each of the additional n strings at one end is coupled to the respective shaft, wherein the method comprises the steps of:

inserting a flanged insert into each individual aperture;

inserting a respective shaft in each elongated bore such that each respective first end of the shaft extends into the aperture of the headstock;

coupling a first end of each additional string to a respective first end of the shaft and coupling a second end of the at least one more string to the termination section; and securing each shaft to the headstock;

whereby:

each of the n additional strings extends over the body and along the neck, and each of the flanged inserts prevent the respective string from direct contact with an edge of the respective aperture and facilitates an improved tone transfer to the headstock.

3. The method as claimed in claim 2, wherein the adding of the additional n strings comprises the steps of adding all of the respective number of additional shafts on the same side planer surface of the headstock.

4. The method as claimed in claim 2, wherein the adding of the additional n strings comprises the steps of adding only half of all the additional number of shafts on the same side planer surface of the headstock.

5. The method as claimed in claim 2, wherein all the added elongated bores originate on the same side planer surface of the headstock.

6. The method as claimed in claim 1, wherein the at least one more string is positioned between two of the initial plurality of strings.

7. The method as claimed in claim 1, including the step of securing the shaft to the headstock by the use of screws and a bracket.

8. The method as claimed in claim 1, including the steps of threading and press-fitting a barrel into the side planer surface; whereby the shaft is sufficiently resisted from removal from the headstock.

9. The method as claimed in claim 1, including the steps of providing threads in the side planer surface, coupling a threaded tuner barrel to the shaft and threadably coupling the tuner barrel into the side planer surface; whereby the shaft is sufficiently resisted from removal from the headstock.

10. The method as claimed in claim 1, including the step of adjusting the string tension of the at least one more string after the step of attaching the at least one more string between the body and the first end of the shaft; wherein the adjusting of the string tension of the at least one more string comprises the step of turning an adjuster coupled to the second end of the shaft.

11. The method as claimed in claim 1, wherein a intonation adjustment screw is coupled intermediate a bridge and a saddle, wherein the at least one more string is provided through a throughhole in the intonation adjustment screw; such that a path is formed for the at least one more string though the intonation adjustment screw, up and over the saddle, which has been regrooved to provide sufficient distance between strings to allow sufficient vibration thereof, over the body, over the neck, through a slot in a nut commensurate with the added groove in the saddle, over the steel flanged insert and terminating with the coupling of the one more string to the shaft.

12. An n stringed instrument, where n is an integer greater than 3 and less than 7, that has been modified to a 2n stringed instrument by the method of adding strings as set forth in claim 1.

13. An n stringed guitar, where n is an integer greater than 3 and less than 7, that has been modified to a 2n stringed guitar by the method of adding strings as set forth in claim 1.

14. An n stringed instrument, where n is an integer greater than 3 and less than 7, that has been modified to a 2n stringed instrument by the method of adding strings as set forth in claim 3.

15. A method of making an n-stringed instrument, where n is an integer greater than 3 and less than 7, comprising n tuners, a headstock on which is disposed the n tuners, a neck coupled to the headstock and a body coupled to the neck, wherein the body has a bridge mounted thereon, wherein each of the n strings is at one end thereof coupled to a respective one of n tuners, extends over and along the neck and at the other end thereof is coupled to a termination section, and wherein the headstock has a front surface, a rear surface and at least one side planer surface, and wherein the headstock has n elongated bores in the side planer surface and wherein the headstock further comprises n individual apertures extending from the front surface to the rear surface of the headstock and each respective elongated bore extends perpendicularly to its associated aperture, wherein the method of connecting each of the n strings to the headstock and the body comprises the steps of:

inserting a steel flanged insert into each individual aperture;

inserting a shaft, having a first end and a second end, in each elongated bore such that the end of each respective shaft extends into its associated aperture of the headstock;

coupling a first end of each respective string to the first end of the shaft and coupling a second end of each respective string to the termination section; and securing each of the n shafts to the headstock;

whereby:

each of the n strings extend over the body and along the neck, and each respective flanged insert prevents its associated string from direct contact with an edge of the respective aperture and facilitates an improved tone transfer to the headstock.

16. The method as claimed in claim 1 wherein the flanged insert is steel.

17. The method as claimed in claim 2 wherein the flanged insert is steel.

18. The method as claimed in claim 15 wherein the flanged insert is steel.

* * * * *